US010047552B2

(12) United States Patent
Lee

(10) Patent No.: US 10,047,552 B2
(45) Date of Patent: Aug. 14, 2018

(54) MOVING WINDOW INSTALLATION STRUCTURE OF SLIDING WINDOW SYSTEM HAVING ALUMINUM ALLOY SASH STRUCTURE

(71) Applicant: Filobe Co., Ltd., Daegu (KR)

(72) Inventor: Kwang-Seok Lee, Daegu (KR)

(73) Assignee: FILOBE CO., LTD, Daegu (KR)

( * ) Notice: Subject to any disclaimer, the term of this patent is extended or adjusted under 35 U.S.C. 154(b) by 505 days.

(21) Appl. No.: 14/388,566

(22) PCT Filed: Apr. 1, 2013

(86) PCT No.: PCT/KR2013/002701
§ 371 (c)(1),
(2) Date: Sep. 26, 2014

(87) PCT Pub. No.: WO2013/151293
PCT Pub. Date: Oct. 10, 2013

(65) Prior Publication Data

US 2015/0052819 A1 Feb. 26, 2015

(30) Foreign Application Priority Data

Apr. 1, 2012 (KR) ..... 10-2012-0033676

(51) Int. Cl.

| | |
|---|---|
| ***E05D 15/10*** | (2006.01) |
| ***E06B 3/46*** | (2006.01) |
| ***E06B 7/23*** | (2006.01) |
| ***E05D 15/06*** | (2006.01) |
| ***E06B 7/16*** | (2006.01) |

(52) U.S. Cl.
CPC ..... *E05D 15/10* (2013.01); *E05D 15/0621* (2013.01); *E05D 15/0665* (2013.01);
(Continued)

(58) Field of Classification Search
CPC .... E06B 3/4627; E06B 3/1609; E06B 3/4609; E06B 3/46; E06B 7/16; E06B 7/2307;
(Continued)

(56) References Cited

U.S. PATENT DOCUMENTS 3,660,936 A * 5/1972 Bryson ..... E06B 3/4627 49/209
5,261,189 A * 11/1993 Chu ..... E05D 15/1042 49/404
6,330,769 B1 * 12/2001 Manzella ..... E06B 3/58 49/453
(Continued)

*Primary Examiner* — Justin B Rephann
(74) *Attorney, Agent, or Firm* — Neifeld IP Law, PC

(57) ABSTRACT

The present invention relates to a moving window installation structure of a sliding window system. More specifically, the present invention relates to a moving window installation structure of a sliding window system which is configured to prevent a vertical reaction force from being applied between a rail and a roller for supporting the weight of a moving window that constitutes a sliding window having an aluminum alloy sash structure such that the moving window can be smoothly moved in a direction perpendicular to the longitudinal direction of the rail and the sliding mobility of a large-sized window having a heavy weight can be improved, and to improve a profile cross-section structure of a window installation frame provided with a sliding window such that heat insulation can be remarkably improved and wind pressure resistance against wind pressure can be enhanced.

20 Claims, 41 Drawing Sheets

(52) U.S. Cl.
CPC ..... *E05D 15/1013* (2013.01); *E06B 3/4627* (2013.01); *E06B 7/16* (2013.01); *E06B 7/2307* (2013.01); *E05Y 2900/148* (2013.01)

(58) Field of Classification Search
CPC ..... E05D 15/0621; E05D 15/0665; E05D 15/1013; E05D 15/1055; E05D 15/10; E05D 15/1042; E05Y 2900/148
USPC ..... 49/211, 225, 316, 319–321
See application file for complete search history.

(56) References Cited

U.S. PATENT DOCUMENTS

2002/0053166 A1* 5/2002 Fries ..... E05B 65/08 49/213
2003/0041538 A1* 3/2003 Ting ..... E06B 3/4609 52/204.5
2007/0234644 A1* 10/2007 Jaeger ..... E05D 15/10 49/362
2007/0234657 A1* 10/2007 Speyer ..... E06B 7/23 52/207
2008/0092452 A1* 4/2008 Chubb ..... E05D 15/0621 49/458
2009/0038228 A1* 2/2009 Lee ..... E05D 15/1042 49/360
2014/0041326 A1* 2/2014 Kadavy ..... E06B 7/16 52/209
2014/0137476 A1* 5/2014 Kim ..... E06B 3/4609 49/305
2015/0121764 A1* 5/2015 Lee ..... E05D 15/0665 49/420

* cited by examiner

[Closed-sealing]

[Lift-sliding]

[Open]

- Fig. 9a -

[Closed]

- Fig. 9b -

HORIZONTAL SECTION (Unsealed State)

(a)

HORIZONTAL SECTION (Sealed State)
(b)

HORIZONTAL SECTION (Opened State)

(c)

VERTICAL SECTION (A-A'): Unsealed State

VERTICAL SECTION (A-A'): Sealed State

VERTICAL SECTION (B-B'): Opened State

MOVING WINDOW INSTALLATION STRUCTURE OF SLIDING WINDOW SYSTEM HAVING ALUMINUM ALLOY SASH STRUCTURE

CROSS REFERENCE TO RELATED APPLICATIONS

This application is a national stage entry of PCT/KR2013/002701, filed Apr. 1, 2013, which published as WO 2013/151293 in a language other than English on Oct. 10, 2013, which claims priority to Korean Application No. 10-2012-0033676, filed Apr. 1, 2012.

TECHNICAL FIELD

The present invention relates to a moving window installation structure of a sliding window system and, more specifically, to a moving window installation structure of a sliding window system which is configured to prevent a vertical reaction force from being applied between a rail and a roller for supporting the weight of a moving window that constitutes a sliding window having an aluminum alloy sash structure such that the moving window can be smoothly moved in a direction perpendicular to the longitudinal direction of the rail and the sliding mobility of a large-sized window having a heavy weight can be improved, and to improve a profile cross-section structure of a window installation frame provided with a sliding window such that heat insulation can be remarkably improved and wind pressure resistance against wind pressure can be enhanced.

BACKGROUND ART

Referring to a most conventional configuration of a sliding frame (within which a panel such as a glass window is installed) and a window frame (which is installed in a rectangular loop shape so that the sliding frame is installed therein) which constitute a sliding window system, such as a horizontally sliding window or a horizontally sliding door, the window frame provided with a guide rail (guide way), which serves as a guide when a moving window is slid, is installed in a rectangular loop shape in a wall of a building, a roller is installed outside of the sliding frame such that the moving window can be smoothly moved along the guide rail installed on the window frame, and the sliding frame having a cross-section structure, inside of which a panel, such as a glass or a sheet material, is installed, is installed inside of the window frame.

However, with such a conventional and simple configuration, it is usually difficult to expect an excellent performance in connection with a soundproof property, an airtight property (windbreak property), a watertight property, a heat insulation property, a wind pressure resistance property, or the like. When a sealing member, such as windbreak hair (mohair) or windbreak gasket, is attached between the window frame and the sliding frame in order to make up for such shortcomings, the performance may be enhanced. However, due to the limitation in a sealing method, the sealing member, such as the windbreak hair or the windbreak rubber, does not provide a high sealing effect. Furthermore, since the sealing member is deformed or worn out as time goes on, it is difficult to maintain the performance constantly.

As a prior art developed in order to make up for the shortcomings of a sliding window system having the above-described conventional structure, a lift and sliding ("LS") type open/close structure will be described with reference to FIGS. 1 and 2. In a case where the moving window 4 is slid as illustrated in FIG. 1, when a handle 4*h* of a moving window 4 is rotated, a force pushing a roller 4*h* at the lower side of the moving window 4 is applied by a mechanism utilizing the principles of the lever and fulcrum. Then, the moving window 4 is wholly moved up from a lower guide rail 1*b* by a reaction force of the roller 4*r* seated on a lower guide rail 1*b* of the window frame (see the partial enlarged view in the "D" portion in FIG. 1. As a result, a lower sealing member 3*b* which has been in contact with the window frame 1 to maintain a hermetically sealed state, such as a rubber gasket, is spaced apart from the window frame 1 and thus the sliding movement of the moving window 4 may be smoothed. In addition, in a state where the movement is completed as illustrated in FIG. 2, when the handle 4*h* of the moving window 4 is rotated in the opposite direction, the roller 4*r* is returned to the inside of the lower frame of the moving window 4 and thus the sliding frame 4 is wholly moved down (see the partial enlarged view in the "D" portion in FIG. 2. As a result, the lower sealing member 3*b*, such as the rubber gasket, is compressed to seal a lower gap between the bottom of the moving window 4 and the window frame 1.

At this time, the sealing of a gap between the top of the moving window 4 and the top of the window frame 1 will be understood when comparing partial enlarged views in the "U" portions in FIGS. 1 and 2. When the moving window 4 is lifted upward and slid, an upper sealing member 3*u* installed on an upper frame of the moving window 4 is spaced apart from an upper guide rail 1*a* installed at the underside of the top portion of the window frame 1, and when the moving window 4 is moved down, the upper sealing member 3*u* comes in contact with the upper guide rail 1*a* in a sealing manner.

It will be understood that in portions between vertical frames of the window frame and the sliding frame, when comparing the partially enlarged views in the "L" portions and in the "R" portions in FIGS. 1 and 2, when the horizontal sliding of the moving window 4 is completed and the window is fully closed, side sealing member 4*s* such as rubber gaskets are compressed to exhibit a sealing performance.

However, the "LS" type open/close structure as described above has problems as follows. The sliding frame having heavy-weighted components related to the roller installed at the lower portion of the moving window should be moved up or down in order to open or close the moving window, which is mechanically disadvantageous due to concentrated loads applied to the roller portion, and an apparatus that should frequently conduct the functions of moving the moving window up and down as described above requires endurable high-performance components. In addition, when the size of the sliding frame exceeds a certain range, it may be difficult to overcome the burden of the weights of the enlarged sliding frame and glass window. Thus, there is a problem in that an applicable size of the sliding frame is limited.

Furthermore, as described above with reference to FIGS. 1 and 2, in a single sliding frame, sealing principles and directions, i.e. sealing methods, are different from each other at the bottom side, lateral sides and top side, respectively, without uniformity. Thus, it is not easy to secure a complete sealing performance at corner portions of the sliding frame and the window frame where the different sealing methods meet. Further, it is difficult to achieve a complete sealing at the top side of the sliding frame since the sealing performance at the top side should be secured only by a small force that causes the upper sealing member 3*u* to be elastically in close contact with the upper guide rail 1*a*. In particular, it is also difficult to block the heat transfer through the upper guide between the inside and outside areas.

As an example, FIGS. 3 to 5 illustrate a sliding window system provided with the "LS" type open/close structure as described in which a window frame and a sliding frame may be made of an aluminum alloy material as illustrated in FIGS. 3 to 5. In such a case, the window frame 1 includes an inner frame 1*a* and an outer frame 1*b* which are made of an aluminum alloy material with a high heat conductivity, and a thermal break 1*c* configured to interconnect the inner and outer frames and made of a synthetic resin material. The window frame 1 is installed in a rectangular loop shape in a wall of a building. Within the window frame 1, a fixed window 2 and a moving window 4 are installed in which each of the fixed window 2 and the moving window 4 includes an inner frame 2*a* or 4*a* and an outer frame 2*b* or 4*b* which are made of an aluminum allow material with a high heat conductivity, and a thermal break 2*c* or 4*c* configured to interconnect the inner and outer frames and made of a synthetic resin material.

FIG. 3 illustrates sectional views of the moving window 4 in a state where the moving window 4 is slid to be closed (upper portion) and in a state where the moving window 4 is slid to be opened (lower portion). FIG. 4 illustrates, as a sectional view taken along line A-A', a state in which a door locking operation is conducted from the state where the moving window 4 is slid and closed as illustrated in the upper portion of FIG. 3, and thus the moving window 1 is moved downward so that the upper sealing member 3*u* and the lower sealing member 3*b* are contacted with the thermal break 1*c* in the widthwise central portion of the window frame 1 in a sealing manner. FIG. 5 illustrates, as a sectional view taken along line A-A', a state in which the moving window 1 is lifted above the roller 4*r* and moved from the state where the moving window 4 is slid and opened (a door-unlocking operation is conducted) as illustrated in the lower portion of FIG. 3, and thus the upper sealing member 3*u* and the lower sealing member 3*b* are not contacted with the thermal break 1*c* in the widthwise central portion of the window frame 1.

Here, as illustrated in FIGS. 3 and 4, a thermal insulation line "INS" interconnecting the thermal break 4*c* installed in the widthwise central portion of the moving window 4 and the thermal break 1*c* installed in the widthwise central portion of the window frame 1 is formed in a substantially linear direction so that the length of the thermal insulation line "INS" itself is formed to be short. In addition, since the thermal break 1*c* installed in the widthwise central portion of the window frame 1 has a structure directly contacting with external air ("air") as illustrated in FIG. 4, it exhibits very limited thermal insulation effect between the inside and outside of the window. Furthermore, in view of the state in which the roller 4*r* is installed within the inner frame 4*a* of the lower frame of the moving window 4, it is unavoidable to arrange the thermal break 4*c* adjacent to the roller 4*r*. However, this is rather disadvantageous in providing support rigidity because the frame supporting the roller 4*r* is cut. In addition, as illustrated along line K-K' in FIG. 3, the materials that form the moving window 4 are formed, from the outside toward the inside, by an outer member 4*b* made of an aluminum alloy material, an intermediate thermal break 4*c* made of a synthetic resin, and an inner frame 4*a* made of an aluminum alloy material which are interconnected with each other. Thus, it is difficult to provide a separate rigid frame capable of improving the longitudinal rigidity of the entire frame of the moving window 4. Thus, there is a problem in that when the window is enlarged, there is no means that may provide sufficient endurance against wind pressure.

As a prior art proposed so as to overcome the shortcomings of the sliding window system provided with the "LS" type open/close structure described above, a moving window open/close apparatus of a sliding window system is disclosed in Korean Patent Publication No. 10-0729222 issued on Jun. 19, 2007. Hereinafter, the moving window open/close apparatus of the sliding window system configured as described in the patent publication will be described.

Hereinbelow, a conventional moving window open/close apparatus of a sliding window system will be described in detail with reference to FIGS. 6 to 13.

As illustrated in FIGS. 6 to 8, a moving window open/close apparatus of a sliding window system is configured such that a moving window 40 is movable along an upper rail 11*a* and a lower rail 11*b* installed in a window frame 10, and in a rail guide assembly 41*a*, 42*a* above an upper frame 40*a* of the moving window, the rail 41*a* is engaged with the upper rail 11*a* and in the roller unit assembly 41*b*, 42*b* below the lower frame 40*b* of the moving window, the roller 41*b* is engaged with the lower rail 11*b*. In addition, the upper frame 40*a* of the moving window 40 is movably mounted on the rail guide assembly 41*a*, 42*a* on the upper frame 40*a* of the moving window 40, and the lower frame 40*b* of the moving window 40 is movably mounted on the roller unit assembly 41*b*, 42*b* below the lower frame 40*b* of the moving window 40. Specifically, when an open/close operation unit (depicted by reference numeral "50" in FIG. 10) installed on a side frame (depicted by reference numeral "40*s*" in FIG. 10) of the moving window 40 is operated, the upper frame 40*a* and the lower frame 40*b* of the moving window 40 are configured to include a displacement component orthogonal to the rail travel direction of the rails 11*a* and 11*b* of the window frame 10, thereby being moved in the back and forth direction (depicted by reference numerals "CL" and "OP" in FIG. 6). In addition, a sealing member 30 made of an elastic material is interposed between the window frame 10 (or a fixed window (depicted by reference numeral "20" in FIG. 7) and the moving window 40 so that the sealing member 30 entirely receives the same pressure in the direction perpendicular thereto by the movement of the moving window 40.

Hereinafter, a detailed configuration causing the moving window 40 to move in the direction orthogonal to the rail travel direction of the rails 11*a* and 11*b* and an operation principle thereof will be described with reference to FIGS. 7 to 9.

FIG. 7 is a perspective view illustrating a main portion of the moving window before the moving window is moved in the direction orthogonal to the rail travel direction, FIG. 8 is a perspective view illustrating the main portion of the moving window after the moving window is moved in the direction orthogonal to the rail travel direction to compress the sealing member, and FIGS. 9*a* and 9*b* are vertical section views illustrating an opened state before the moving window is moved in the direction orthogonal to the rail travel direction (FIG. 9*a*) and a closed state after the moving window is moved in the direction orthogonal to the rail travel direction (FIG. 9*b*).

As illustrated in FIGS. 7 and 8, when the roller unit assembly 41*b*, 42*b* is pushed by a moving force Fp including a component parallel to the rail travel direction of the lower rail 11*b*, the moving force Fb is divided into two component forces, i.e. a horizontal component force Fh and a vertical component force Fv by an inclined connection structure of an inclined guide slot 43*b*, which is formed to be inclined (by a set angle in relation to the longitudinal direction of the lower rail when viewed on a plan view) on the plate 42*b* positioned at the upper side in the roller unit assembly 41*b*, 42*b*, and a guide protrusion 44*b*, which is formed to protrude downward from the bottom surface of the lower frame 40*b* of the moving window 40. At this time, the direction of the vertical component force Fv acting in a direction orthogonal to the rail travel direction is changed to the opposite direction because the roller 41*b* positioned at the lower side of in the roller unit assembly 41*b* and 42*b* is restrained not to turn aside in the direction orthogonal to the rail travel direction of the lower rail 11*b* so that the roller 41*b* cannot be displaced in the direction orthogonal to the rail travel direction. The reaction force which has the same magnitude as the vertical component force but is directed opposite to the vertical component force acts to move the lower frame 40*b* of the moving window 40 by the width D of the inclined guide slot 43*b* in the back and forth direction orthogonal to the rail travel direction. Using the moving action in the back and forth direction is a main principle of the moving window open/close apparatus of the sliding window system which is the prior art.

Meanwhile, FIG. 10 is a perspective view illustrating a main portion of an exemplary embodiment of an open/close operation unit in the moving window open/close apparatus of the sliding window system as described above, FIG. 11 is a perspective view illustrating a main configuration of FIG. 10 and an operating state of the main portion thereof, and FIG. 12 is a view illustrating states before and after the moving window is moved in the direction orthogonal to the longitudinal direction of the rail in the moving window open/close apparatus of the sliding window system to which the open/close operation unit of FIG. 10 is applied.

In particular, FIGS. 10 to 12 exemplify one open/close operation unit for specifically implementing the operation principle of the prior art illustrated in FIGS. 6 to 9. Various application examples for such an open/close operation unit are the prior arts disclosed in the Korean patents filed and issued in the name of the present applicant, that is Korean Patent No. 10-0729222 (corresponding to PCT Publication No. WO 2007/075075) described above, Korean Patent No. 10-0671256 (corresponding to PCT Publication No. WO 2007/139354) issued on Jan. 19, 2007, and Korean Patent No. 10-0729223 (corresponding to PCT Publication No. WO 2007/139355) issued on Jun. 19, 2007. One of the application examples corresponds to the sliding-type open/close operating unit 50 illustrated in FIGS. 13 and 14. Specifically, the sliding-type open/close operating unit 50 includes: a side sliding bar 50*s* installed in a vertical direction on a side frame of a moving window 40 to be vertically movable; a rotation handle 50*h* installed to apply an operation force for moving the side sliding bar 50*s* vertically; a gear mechanism 50L, 50P installed to convert a rotation movement of the rotation handle 50*h* to a vertical reciprocal movement of the side sliding bar 50*s*; elastic sliders 51*s*, each of which is installed at a corner to be connected to an upper or lower end of the side sliding bar 50*s* and transfer the reciprocal movement to an upper or lower portion of the moving window 40; upper and lower sliding bars 51*a* and 51*b* installed horizontally at the upper and lower portions of the moving window 40 to be interlocked with the elastic sliders 51*s*; and connecting rod members 52*a* and 52*b* configured to link the upper and lower sliding bars 51*a* and 51*b* to the lower plate 42*a* of the rail guide assembly and the upper plate 42*b* of the roller unit assembly, respectively. In the case of the open/close operation unit illustrated in FIGS. 13 and 14, when the rotation handle 50*h* is operated, horizontal displacements produced in the lower plate 42*a* of the rail guide assembly and the upper plate 42*b* of the roller unit assembly of the moving window act in the opposite directions, unlike the exemplary embodiment illustrated in FIG. 11. Thus, the directions of upper and lower inclined guide slots 43*a*1 and 43*a*2, 43*b*1 and 43*b*2 are opposite to each other, and the initial positions of guide protrusions 44*a* and 44*b* fitted to the inclined guide slots 43*a*1 and 43*a*2, 43*b*1 and 43*b*2, respectively, are opposite to each other.

However, according to the prior art provided with the above-described structure, when the roller unit assembly 41*b*, 42*b* is pushed by a moving force Fp including a component parallel to the rail travel direction of the lower rail 11*b*, the above-described reaction force acts between the roller 41*b* and the lower rail 11*b* by the vertical component force Fv acting in the direction orthogonal to the rail travel direction. Consequently, the reaction force also may act as a large frictional force between the roller and the rail and may disturb the movement of the roller which is to be traveled along the rail by the horizontal component force Fh. That is, even if the roller unit assembly is pushed using the open/close operation unit, the roller may not be moved due to the frictional force which may be generated between the roller and the rail by the above-described reaction force.

In addition, in view of the fact that the weight of the moving window 40 applied to a system type window is remarkably larger than the weight of a moving window applied to an ordinary window due to a configuration of the open/close unit 50 or the like, a large frictional resistance is applied between the lower frame 40*b* of the moving window 40 and the upper plate 42*b* of the roller unit assembly 41*b*, 42*b* during the vertical movement of the moving window 40, which may be an obstacle to the smooth vertical movement of the moving window 40.

DETAILED DESCRIPTION OF THE INVENTION

Technical Problem

The present invention has been made in an effort to solve the problems as described above and a technical object of the present invention is to provide a moving window installation structure of a sliding window system which is configured to improve a profile cross-section structure of a window installation frame provided with a sliding window such that heat insulation can be remarkably improved and wind pressure resistance against wind pressure can be enhanced, and to provide a sliding window structure which is configured to prevent a vertical reaction force from being applied between a rail and a roller for supporting the weight of a moving window that constitutes a sliding window having an aluminum alloy sash structure such that the moving window can be smoothly moved in a direction perpendicular to the longitudinal direction of the rail.

Another technical object of the present invention is to provide a sliding window structure which is configured such that the moving window can be smoothly slid while the moving window is moved substantially in the vertically direction regardless of the magnitude of the weight of the moving window, so as to ensure that a complete sealing action can be smoothly performed.

Technical Solution

In order to achieve the above-described objects, the present invention provides a moving window installation structure of a sliding window system of an aluminum alloy sash structure. The sliding window system includes:

a window frame including an inner frame and an outer frame which are made of an aluminum alloy, and a thermal break which interconnects the inner and outer frames and is made of a synthetic resin, the window frame being installed in a rectangular loop shape in a building wall and a rail guide being installed in the horizontal direction on a bottom surface of the window frame; and a fixed window and a moving window as window members installed within the window frame, each of which includes an inner frame and an outer frame which are configured to support a window panel, such as a glass window, and is made of an aluminum alloy material with a high thermal conductivity, and a thermal break which interconnects the inner and outer frames and is made of a synthetic resin.

The moving window installation structure of the sliding window system further includes: a moving window sealing frame including a first thermal break sealing member on a front surface, the moving window sealing frame being made of an aluminum alloy material and provided in a rectangular loop shape in a moving window closing region inside the outer frame of the window frame to interconnect the inner frame and the outer frame;

a roller device installed below the moving window to be separated from the moving window so as to provide a vertical sliding movement of the moving window along the length of the rail guide of the window frame for sealing in relation to the moving window sealing frame;

a moving window horizontal-moving device installed in an inner pocket of the lower frame of the moving window to conduct a horizontal sliding movement for sealing across the rail guide such that a second thermal break sealing member which is provided on a rear surface of the moving window by separating the moving window from the roller device comes in contact with the first thermal break sealing member of the moving window sealing frame; and a vertical sliding unit provided between a top surface of the roller device and a bottom surface of the lower frame of the moving window so as to guide rolling movement while allowing only a moving displacement of the lower frame of the moving window orthogonal to the rail travel direction of the rail guide in relation to the top surface of the roller device, so that a vertical component force is not applied to the roller device while the moving window conducts a sealing sliding movement across the rail guide by the operation of the moving window horizontal-moving device, and the moving window and the roller device can travel integrally while the moving window is moved along the longitudinal direction of the rail guide.

A thermal break, which is made of a synthetic resin material and installed to interconnect the inner frame and the outer frame that constitute the window frame in a heat transfer blocking manner, and a thermal break, which is made of a synthetic resin material and installed to interconnect the moving window sealing frame connected to the outer frame and the inner frame in a heat transfer blocking manner, are arranged such that the installation directions of the thermal breaks are orthogonal to each other, and thus the inner frame, the outer frame, the moving window sealing frame, and the inner frame are connected in a rectangular loop shape through the thermal breaks to form a thermal insulation air layer therein.

Here, more preferably, the moving window horizontal-moving device installed in the inner pocket of the lower frame of the moving window includes:

a fixed frame fixedly installed in a planar frame shape on the moving window and including a guide protrusion (not illustrated) formed to protrude from the frame surface or an inclined guide slot formed to be inclined at a predetermined angle in relation to the rail guide;

a movable frame slidably provided adjacent to the fixed frame on a plane, and including an inclined guide slot formed to be inclined at a predetermined angle in relation to the longitudinal direction of the rail guide 100*r* so that the guide protrusion is inserted into the inclined guide slot to be guided in a sliding manner or a guide protrusion formed to protrude from the frame surface, the movable frame being provided in the inner pocket of the lower frame of the moving window to be slidable in the direction parallel to the rail travel direction;

an open/close operation drive unit fixedly installed on a side surface of the moving window 300 and connected to the movable frame to apply a moving force in the direction parallel to the rail travel direction;

a front support rail and a rear support rail provided on the front surface and the rear surface of the rail guide in the window frame, respectively, to be spaced apart from each other by a predetermined spacing; and a compression unit provided on the movable frame such that when the movable frame is moved by the open/close operation drive unit, the compression unit provides a reflection force that moves the moving window in the horizontal direction which is orthogonal to the rail travel direction while pushing the moving window in the direction orthogonal to the rail travel direction between the moving window and the front support rail or the rear support rail with respect to the moving force in the inclined direction of the guide protrusion and the inclined guide slot.

Here, a side flexure rigidity reinforcement member 320 is preferably inserted and installed in a reinforcement material pocket, which is additionally formed adjacent to a side pocket in which the movable frame constituting the moving window horizontal-moving device is provided to extend from the inner pocket of the lower frame of the moving window to the open/close drive unit on the side surface of the moving window, so as to reinforce the flexural rigidity in the vertical longitudinal direction of the moving window.

In addition, the vertical sliding unit is provided between the roller device and the moving window horizontal-moving device such that no vertical component force is applied to the roller device while the moving window is slid for sealing in the vertical direction by the moving window horizontal-moving device.

The vertical sliding unit may include: a flat plate member provided on a bottom surface of the fixed frame that constitutes the moving window horizontal-moving device; and a bearing unit provided on a plane of the roller device to be in contact with the plate member and configured to slip only in a direction orthogonal to the longitudinal direction of the central rail.

As an example, the bearing unit may include a bearing mount provided on a plane of the roller device, and one or more pin type roller bearings which are arranged in the bearing mount to have the same longitudinal direction as the longitudinal direction of the central rail.

In addition, in order to provide a structure which slips only in the direction orthogonal to the longitudinal direction of the rail guide as described above, the vertical sliding unit may include an engagement step provided on a bottom surface of the fixed frame, and an engagement step formed on the plane of the roller device to be engaged with the engagement step on the fixed frame.

In addition, the compression unit may include a support member which is fixed to an end of the guide protrusion of the movable frame and slidably provided on the bottom surface of the fixed frame, and a circular compression roller which is rotatably provided on the support member such that the circular compression roller moves the moving window while directly pushing the front support rail or the rear support rail, and also minimizes contact friction with the front support rail or the rear support rail while the movable frame and the support member are moved over a predetermined distance.

In addition, the circular compression roller is rotatably provided at the center of the bottom surface of the support member, and the diameter of the circular compression roller may be set to be smaller than the spacing between the front support rail and the rear support rail, and to allow the moving window to be moved by a predetermined distance in the vertical direction by the moving window horizontal-moving device.

In addition, the moving window horizontal-moving device may further include a lubricant sheet provided between the support member and the fixed frame such that the movable frame and the support member may be smoothly slid on the fixed frame.

In addition, when an extension movable frame is provided to be spaced apart from the movable frame by a predetermined distance in order to extend the length of the movable frame, the support member may be configured to interconnect the movable frame and the extension moving frame.

In addition, the roller device may include: a bottom-opened housing; a plate-shaped weight support plate mounted within the housing to support the weight of the moving window; and an annular rolling unit wound around the weight support plate to be rotated around the weight support plate as an axis when the moving window is moved along the central rail of the window frame. In particular, the annular rolling unit may include a plurality of rolling members, and a link unit interconnecting the plurality of rolling members such that the plurality of rolling members are evenly arranged on the surface of the weight support plate at a predetermined interval.

In addition, the roller device may further include a guide unit that guides the annular rolling unit without slipping to the left and right of the weight support plate. As an example, the guide unit may include a guide rail formed on the weight support plate therearound, and guide grooves which are formed on the plurality of rolling members, respectively, to correspond to the guide rail.

Furthermore, the rail guide may further include: a central rail provided between the front support rail and the rear support rail to guide the plurality of rolling members; and an auxiliary guide rail having a longitudinal direction which is the same as that of the central rail and formed to protrude on a plane of the central rail, and the auxiliary guide rail may be inserted into the guide grooves so as to prevent the roller device from rocking from side to side.

In addition, the roller device may further include foreign matter curtains which are provided at front and rear portions of the housing with reference to the moving direction of the housing, respectively, so as to prevent foreign matter on the central rail and the auxiliary guide rail from being introduced into the housing and to cause the foreign matter to be swept to the outside of the housing.

In addition, the vertical sliding unit may be provided between the housing of the roller device and the fixed frame of the moving window horizontal-moving device. Further, the roller device may further include side rollers which are rotatably provided on the opposite side surfaces, respectively, so as to reduce contact resistance when the housing is contacted with the front support rail and the rear support rail.

Advantageous Effects

According to the present invention it is possible to provide an installation structure of a sliding window system which enables sealing and unsealing of a sliding window in which a profile cross-section structure of a window installation frame provided with a sliding window of an aluminum alloy sash structure is improved such that a heat insulation function can be remarkably improved, a dew condensation phenomenon can be minimized, and a wind pressure resistance against wind pressure can be enhanced. It is also possible to provide an open/close structure of a sliding window in which the moving window can be smoothly slid for sealing in a direction orthogonal to the longitudinal direction of a rail while preventing a vertical reaction force from being applied between the rail and the roller device.

In addition, according to the present invention, the moving window can be smoothly slid while the moving window is moved in a substantially vertical direction regardless of the magnitude of the weight of the moving window so that a complete sealing action can be smoothly implemented.

MODE FOR CARRYING OUT THE INVENTION

Hereinafter, exemplary embodiments of the present invention will be described with reference to the present invention such that a person ordinarily skilled in the art to which the present invention belongs can easily carry out the present invention. However, the present invention may be implemented in various different forms and is not limited to the exemplary embodiments described herein.

First, a sliding window system of an aluminum alloy sash structure according to an exemplary embodiment of the present and a moving window installation structure thereof will be described with reference to FIGS. 15 to 27.

Figure 15:
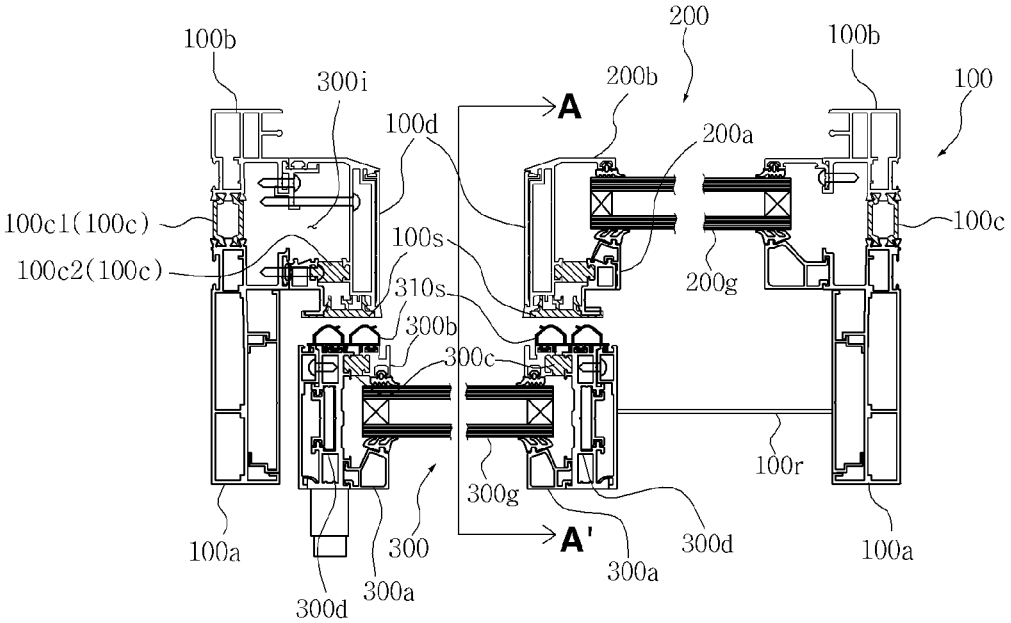
FIG. 15 is a horizontal sectional view of a sliding window system of an aluminum alloy sash structure according to an exemplary embodiment of the present invention in which a moving window is illustrated in a state before it is slid for sealing.
Figure 16:
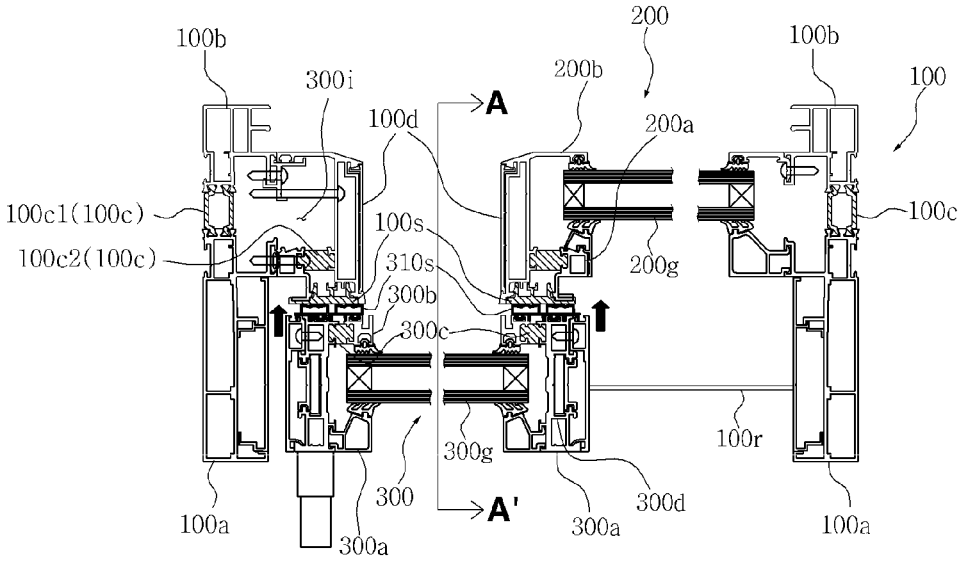
FIG. 16 is a horizontal sectional view of a sliding window system of an aluminum alloy sash structure according to an exemplary embodiment of the present invention in which the moving window is illustrated in a state after being slid for sealing.
Figure 17:
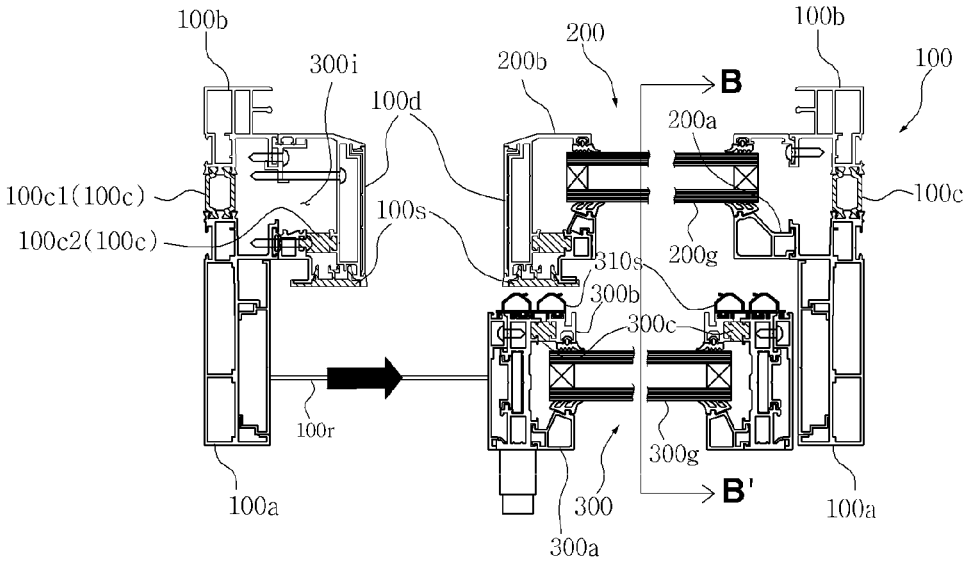
FIG. 17 is a horizontal sectional view of a sliding window system of an aluminum alloy sash structure according to an exemplary embodiment of the present invention in which the moving window is illustrated in a state in which it is opened.
Figure 19:
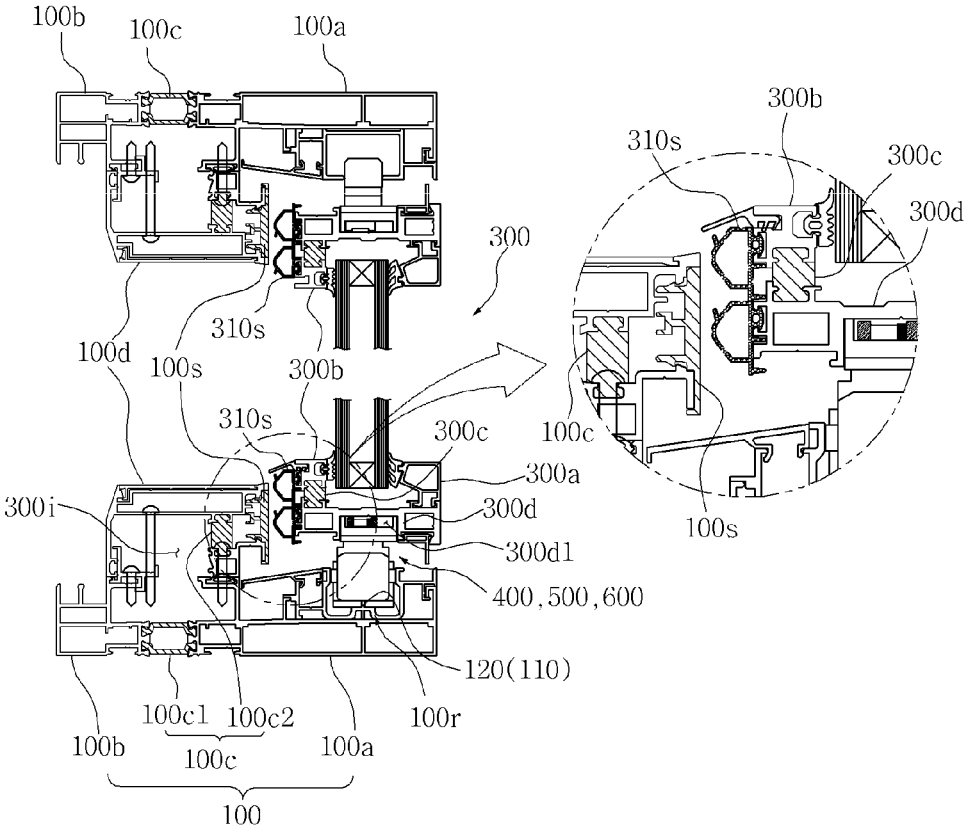
FIG. 19 is a sectional view taken along line A-A' in FIG. 15.
Figure 20:
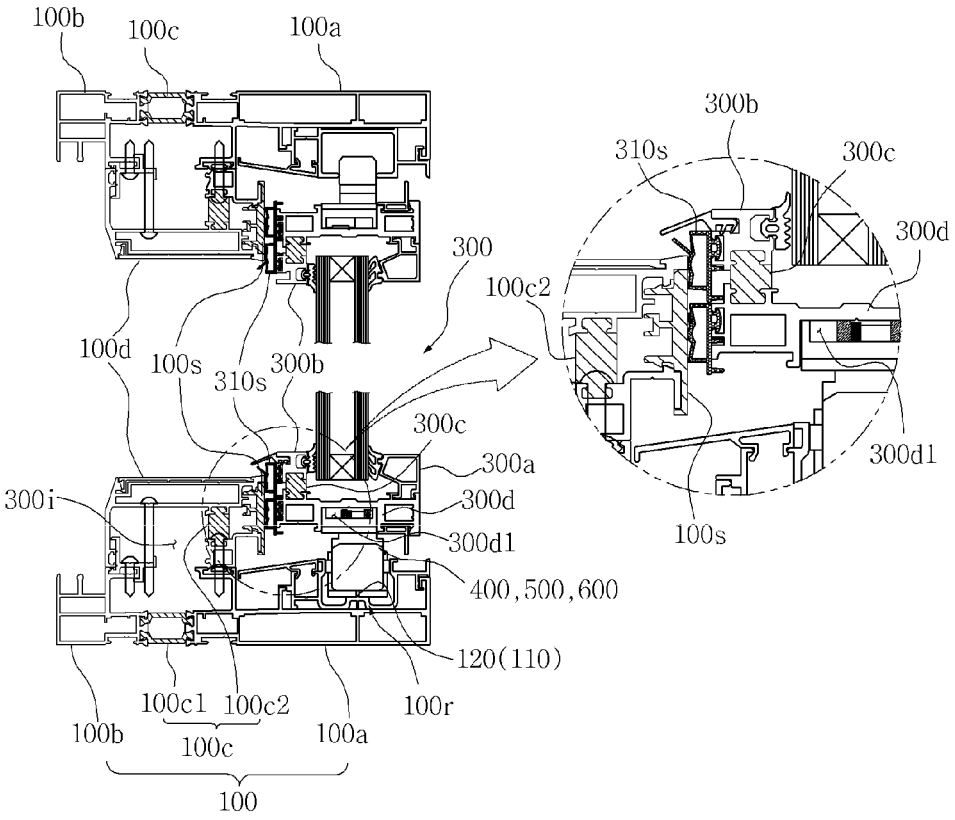
FIG. 20 is a sectional view taken along line A-A' in FIG. 16.
Figure 21:
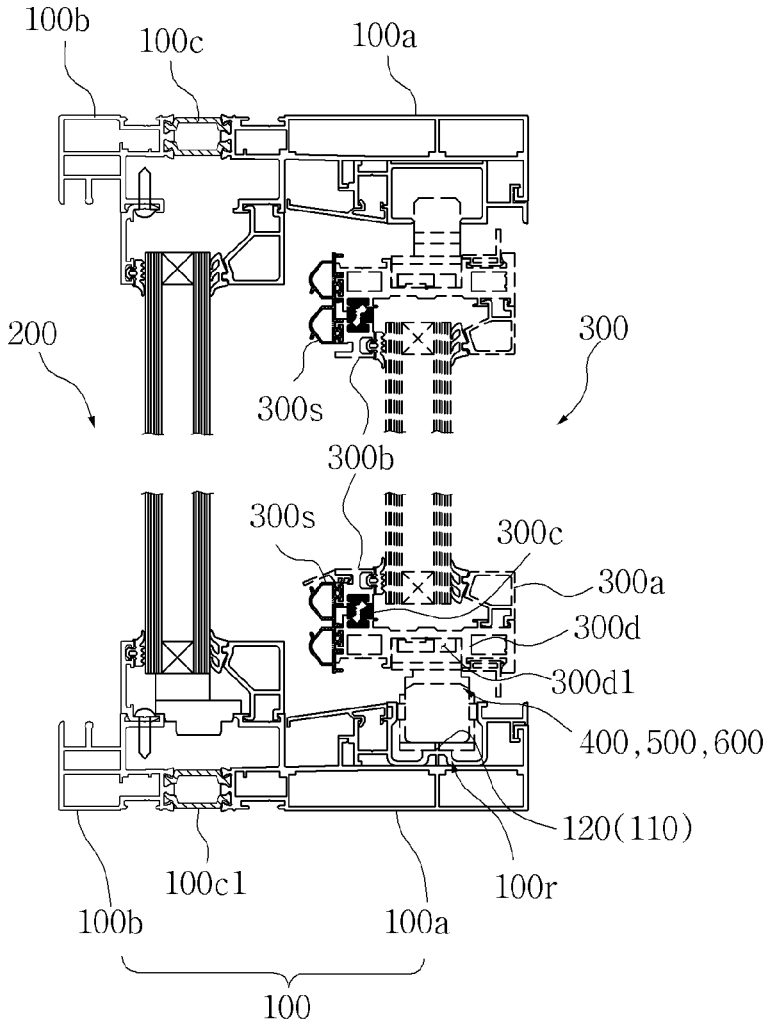
FIG. 21 is a sectional view taken along line B-B' in FIG. 17.

Here, FIG. 15 is a horizontal sectional view of a sliding window system of an aluminum alloy sash structure according to an exemplary embodiment of the present invention in which a moving window is illustrated before it is sealingly slid (state "a"), FIG. 16 illustrates the moving window after it is sealingly slid (state "*b*"), and FIG. 17 illustrates a state in which the moving window is moved to the right side to be opened to the outside (state "c"). In addition, FIG. 19 is a sectional view taken along line A-A' in FIG. 15, FIG. 20 is a sectional view taken along line A-A' in FIG. 16, and FIG. 21 is a sectional view taken along line B-B' in FIG. 17.

As illustrated in the drawings described above, the sliding window system of the aluminum alloy sash structure according to the present invention includes: a window frame 100 basically including an inner frame 100*a* and an outer frame 100*b* made of an aluminum alloy with a high thermal conductivity and a thermal break 100*c*1 interconnecting the inner and outer frames 100*a* and 100*b* and made of a synthetic resin, the window frame 100 being installed in a rectangular loop shape in a building wall and a rail guide being installed on a bottom surface of the window frame 100; and a fixed window 200 and a moving window 300 as window members installed within the window frame 100, each of which includes an inner frame 200*a* or 300*a* and an outer frame 200*b* or 300*b* which are configured to support a window panel 200*g* or 300*g*, such as a glass window, and made of an aluminum alloy material with a high thermal conductivity, and a thermal break 200*c* or 300*c* interconnecting the inner and outer frames and made of a synthetic resin.

A moving window installation structure of the sliding window system further includes: a moving window sealing frame 100*d* including, on a front surface, a first thermal break sealing member 100*s* which may be made of, for example, a synthetic resin material, the moving window sealing frame 100*d* being made of an aluminum alloy material and provided in a rectangular loop shape in a moving window closing region inside the outer frame 100*b* of the window frame to interconnect the inner frame 100*a* and the outer frame 100*b;* a roller device 400 installed below the moving window 300 to be separated from the moving window 300 so as to provide a vertical sliding movement of the moving window 300 along the length of the rail guide 100*r* of the window frame 100 for sealing in relation to the moving window sealing frame 100*d;* a moving window horizontal-moving device 500 provided on a rear surface of the moving window 300 by separating the moving window 300 from the roller device 400, and installed in an inner pocket of the lower frame 300*d* of the moving window 300 to conduct a horizontal sealing sliding movement across the rail guide 100*r* such that a second thermal break sealing member 310*s* which may be made of an elastic material, for example, a synthetic rubber, comes in contact with the first thermal break sealing member 100*s* of the moving window sealing frame 100*d*; and a vertical sliding unit 600 provided between a top surface of the roller device 400 and a bottom surface of the lower frame 300*d* of the moving window 300 so as to guide rolling movement while allowing only a moving displacement orthogonal to the rail travel direction of the rail guide 100*r* of the lower frame 300*d* of the moving window 300 in relation to the top surface of the roller device 400, so that a vertical component force is not applied to the roller device 400 while the moving window 300 conducts a sealing sliding movement across the rail guide 100*r* by the operation of the moving window horizontal-moving device 500, and the moving window 300 and the roller device 400 can travel integrally while the moving window 300 is moved along the longitudinal direction of the rail guide 100*r*.

Here, a thermal break 100*c*1, which is made of a synthetic resin material and installed to interconnect the inner frame 100*a* and the outer frame 100*b* that constitute the window frame 100 in a heat transfer blocking manner, and a thermal break 100*c*2, which is made of a synthetic resin material and installed to interconnect the moving window sealing frame 100*d* connected to the outer frame 100*b* and the inner frame 100*a* in a heat transfer blocking manner are arranged such that the installation directions of the thermal breaks 100*c*1 and 100*c*2 are orthogonal to each other, and thus the inner frame 100*a*, the outer frame 100*b*, the moving window sealing frame 100*d*, and the inner frame 100*a* are connected in a rectangular loop shape through the thermal breaks 100*c*1 and 100*c*2 (100*c*) so as to form a thermal insulation air layer 300*i* therein.

Figure 22:
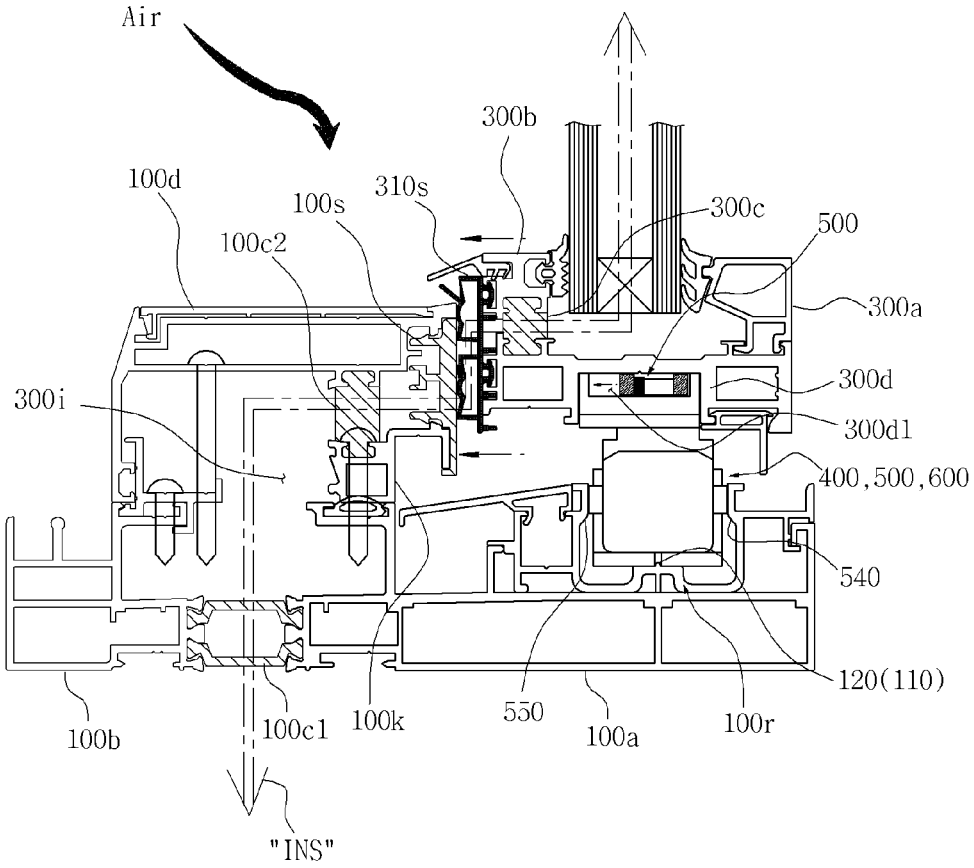
FIG. 22 is a horizontal sectional view of a sliding window system of an aluminum alloy sash structure according to an exemplary embodiment of the present invention in which a heat insulation configuration (heat insulation line) is illustrated in a state where the moving window is slid for sealing.
Figure 23:
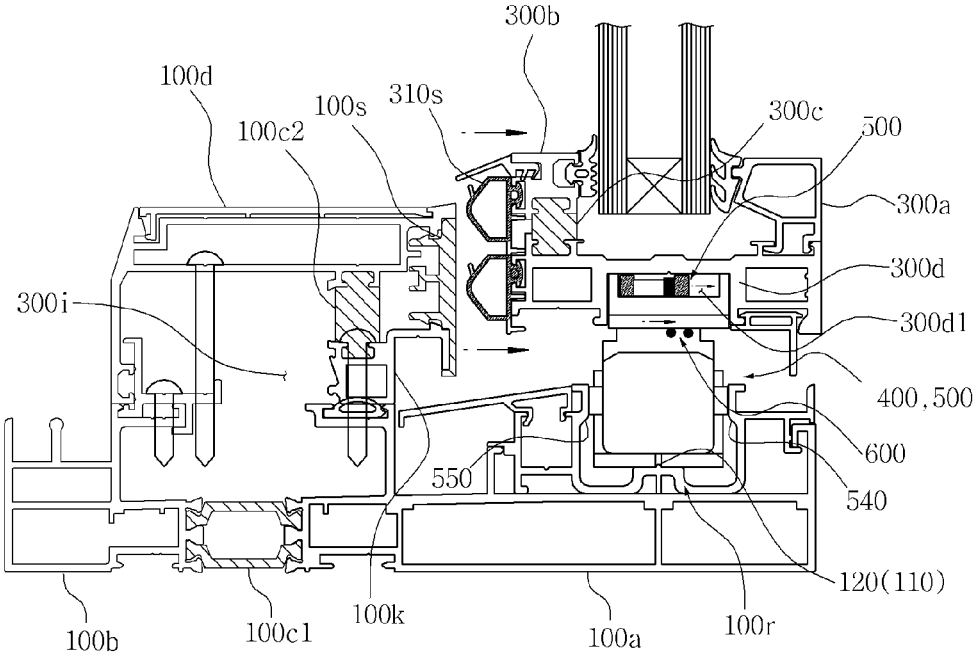
FIG. 23 is a side sectional view illustrating an operating state from FIG. 20 (sealing state) to FIG. 19 (unsealing state)
Figure 24:
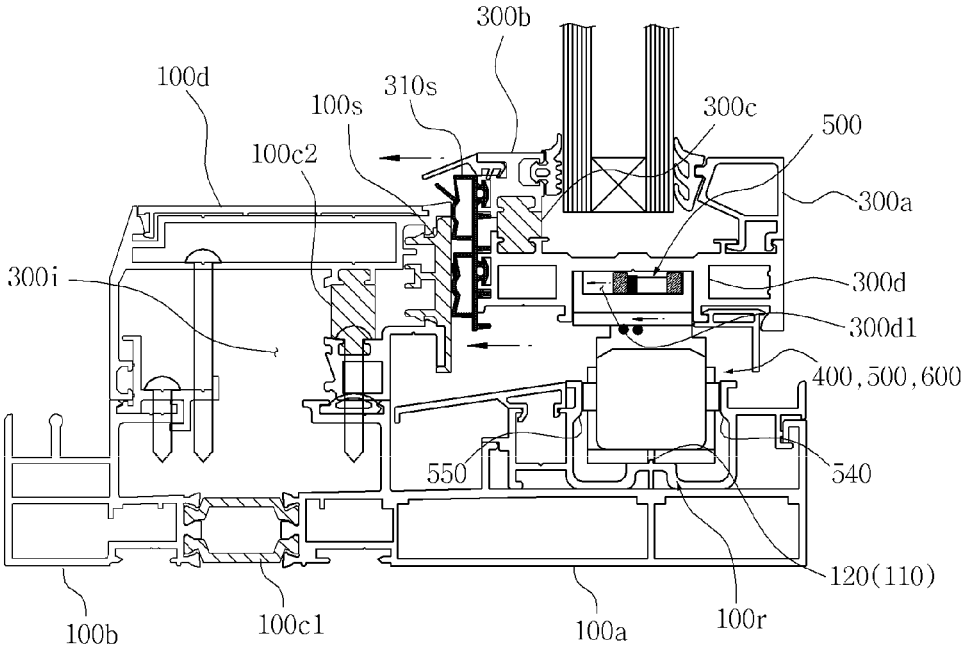
FIG. 24 is a side sectional view illustrating an operating state from FIG. 19 (unsealing state) to FIG. 20 (sealing state)

In the moving window installation structure of the sliding window system of the aluminum alloy sash structure configured as described above, as illustrated in FIG. 22 in an enlarged scale, because the thermal break 100*c*, which is made of the synthetic resin material and installed to interconnect the inner frame 100*a* and the outer frame 100*b* that constitute the window frame 100 in the heat transfer blocking manner, and the thermal break 100*c*2, which is made of the synthetic resin material and installed to interconnect the moving window sealing frame 100*d* connected to the outer frame 100*b* and the inner frame 100*a* in the heat transfer blocking manner, are arranged such that the installation directions of the thermal breaks 100*c*1 and 100*c*2 are orthogonal to each other, the inner frame 100*a*, the outer frame 100*b*, the moving window sealing frame 100*d*, and the inner frame 100*a* are connected in a rectangular loop shape through the thermal breaks 100*c*1 and 100*c*2 (100*c*) so as to form a thermal insulation air layer 300*i* therein. As a result, as illustrated in FIG. 22, between a connection structure of the moving window sealing frame 100*d* and the outer frame 100*b* which forms an outer primary vertical connection structure and a connection structure of the moving window 300 and the inner frame 100*a* which forms an inner secondary vertical connection structure, an insulation line "INS", which is formed by a thermal break 300*c*, a second thermal break sealing member 310*s* of the moving window 300, a second thermal break sealing member 310*s*, the first thermal break sealing member 100*s*, the thermal break 100*c*2, the thermal insulation air layer 300*i*, and the thermal break 100*c*1, is substantially completely constructed from the outside of the window to the inside of the building, thereby providing a high heat insulation efficiency, and also preventing a dew condensation phenomenon of an aluminum alloy sash which occurs when a high temperature difference occurs between the inside and outside of the window. Meanwhile, a connection body depicted by reference numeral "100*k*" in FIG. 22 is provided as a connection structure so as to connect the moving window sealing frame 100*d* and the inner frame 100*a*, in which the first thermal break sealing member 100*s* and the thermal break 100*c*2 are installed between the moving window sealing frame 100*d* and the connection body 100*k*.

Furthermore, no thermal break is arranged adjacent to the window panel 300*g* positioned between the inner frame 300*a* and the outer frame 300*b* that constitute the moving window 300 so that the moving window horizontal-moving device 500 having the detailed configuration to be described later can be positioned at the central portion of the window, which is helpful in obtaining a mechanically advantageous acting effect that reduces the force required for operating the open/close operation drive unit for a sealing sliding movement by the moving window horizontal-moving device 500.

Here, as illustrated in FIGS. 23 to 27 as well as in the above-described drawings, the moving window horizontal-moving device 500 installed in the inner pocket 300*d*1 of the lower frame 300*d* of the moving window 300 may include:

a fixed frame 510 fixedly installed in a planar frame shape on the moving window 300 and including a guide protrusion (not illustrated) formed to protrude from the frame surface or an inclined guide slot 511 formed to be inclined at a predetermined angle in relation to the longitudinal direction of the rail guide 100*r;* a movable frame 520 slidably provided to be adjacent to the fixed frame 510 on a plane, and including an inclined guide slot (not illustrated) formed to be inclined at a predetermined angle in relation to the longitudinal direction of the rail guide 100*r* so that the guide protrusion is inserted into the inclined guide slot to be guided in a sliding manner or a guide protrusion 521 formed to protrude from the frame surface, the movable frame 520 being provided in the inner pocket 300*d*1 of the lower frame 300*d* of the moving window 300 to be slidable in the direction parallel to the rail travel direction;

an open/close operation drive unit 530 fixedly installed on a side surface of the moving window 300 and connected to the movable frame 520 to apply a moving force in the direction parallel to the rail travel direction;

a front support rail 540 and a rear support rail 550 provided on the front surface and the rear surface of the rail guide 100*r* in the window frame 100, respectively, to be spaced apart from each other by a predetermined spacing; and a compression unit 560 provided on the movable frame 520 such that when the movable frame 520 is moved by the open/close operation drive unit 530, the compression unit 560 provides a reflection force that moves the moving window 300 in the horizontal direction which is orthogonal to the rail travel direction while pushing the moving window 300 in the direction orthogonal to the rail travel direction between the moving window 300 and the front support rail 540 or the rear support rail 550 with respect to the moving force in the inclined direction of the guide protrusion 521 and the inclined guide slot 511.

Figure 18:
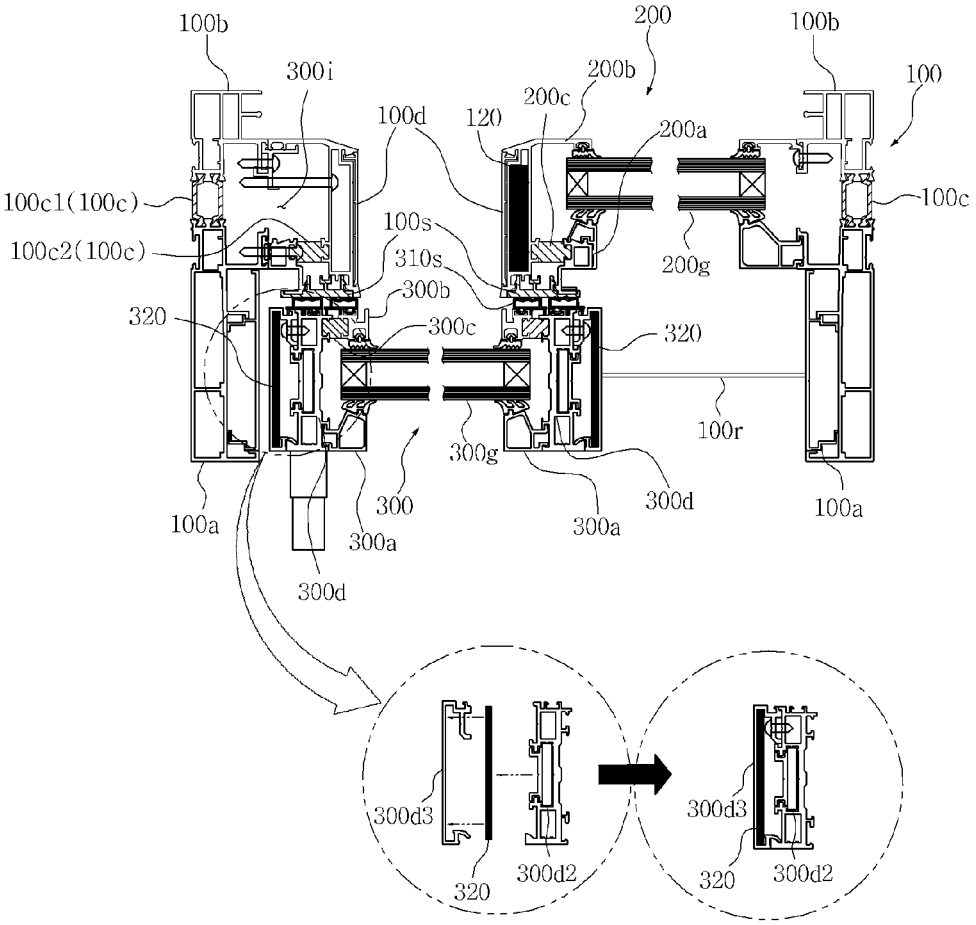
FIG. 18 is a horizontal sectional view of a sliding window system of an aluminum alloy sash structure according to another exemplary embodiment of the present invention in which the figure illustrates a state in which a side flexural rigidity reinforcement material is additionally installed in the moving window in order to enhance a wind resistance property.

Here, as illustrated in FIG. 18, in the movable frame 520 that constitutes the moving window horizontal-moving device 500, a side flexure rigidity reinforcement member 320 is preferably inserted and installed in a reinforcement material pocket formed by a reinforcement material installation cover 300*d*3 which is additionally installed adjacent to a side pocket 300*d*2 provided to extend from the inner pocket 300*d*1 (see FIG. 19) of the lower frame 300*d* of the moving window 300 to the open/close drive unit 530 on a side surface from the moving window 300 so as to reinforce the flexural rigidity in the vertical longitudinal direction of the moving window 300. As a result, the moving window 300 exhibits a high wind pressure resistance property. Meanwhile, as illustrated in FIG. 18, a flexural rigidity reinforcement material 120 may also be installed in the inside of the moving window sealing frame 100*d*.

Figure 25:
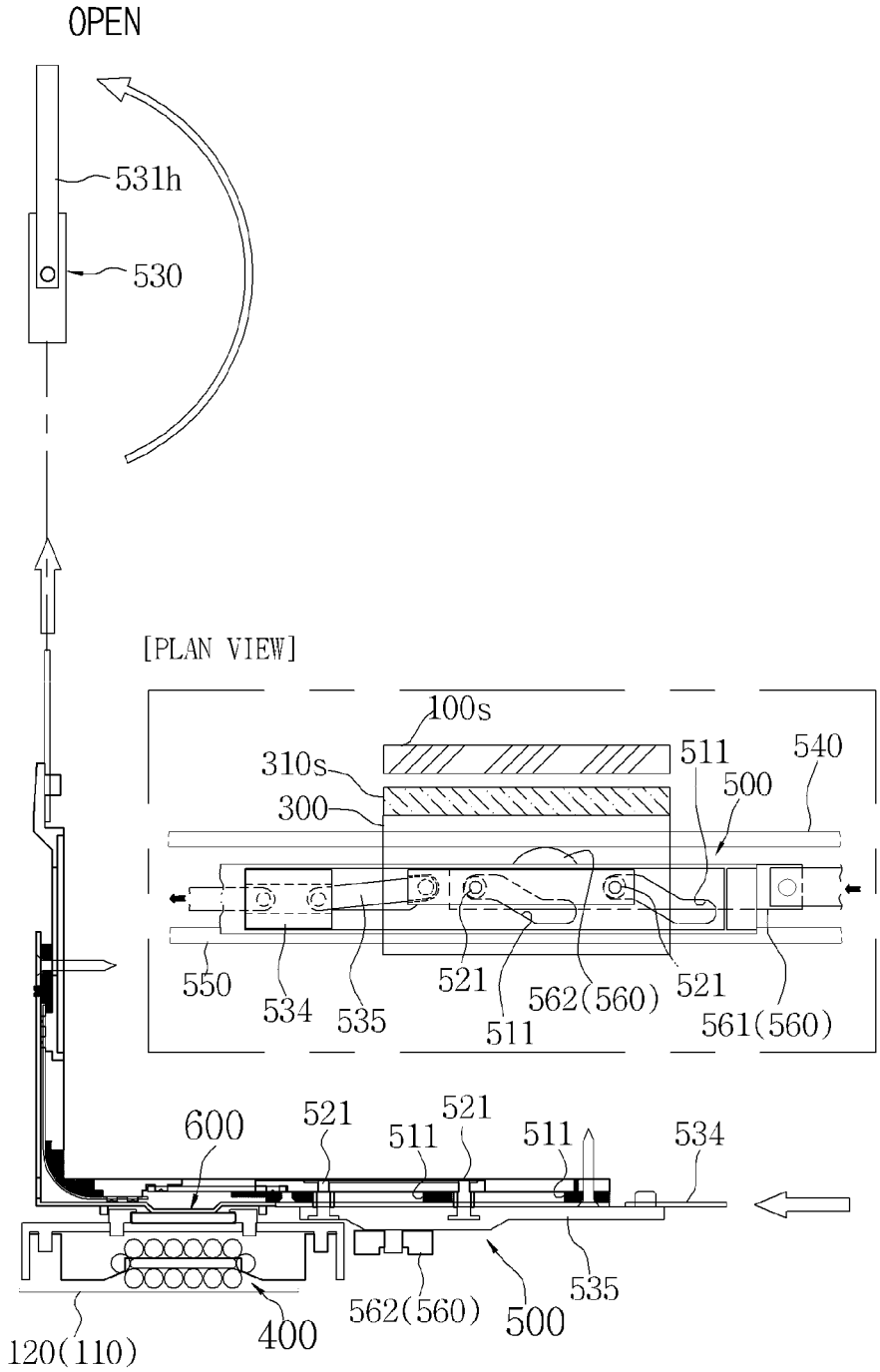
FIG. 25 is a side sectional view illustrating an operating state from FIG. 20 (sealing state) to FIG. 19 (unsealing state) which is viewed from the front side of the window frame.
Figure 26:
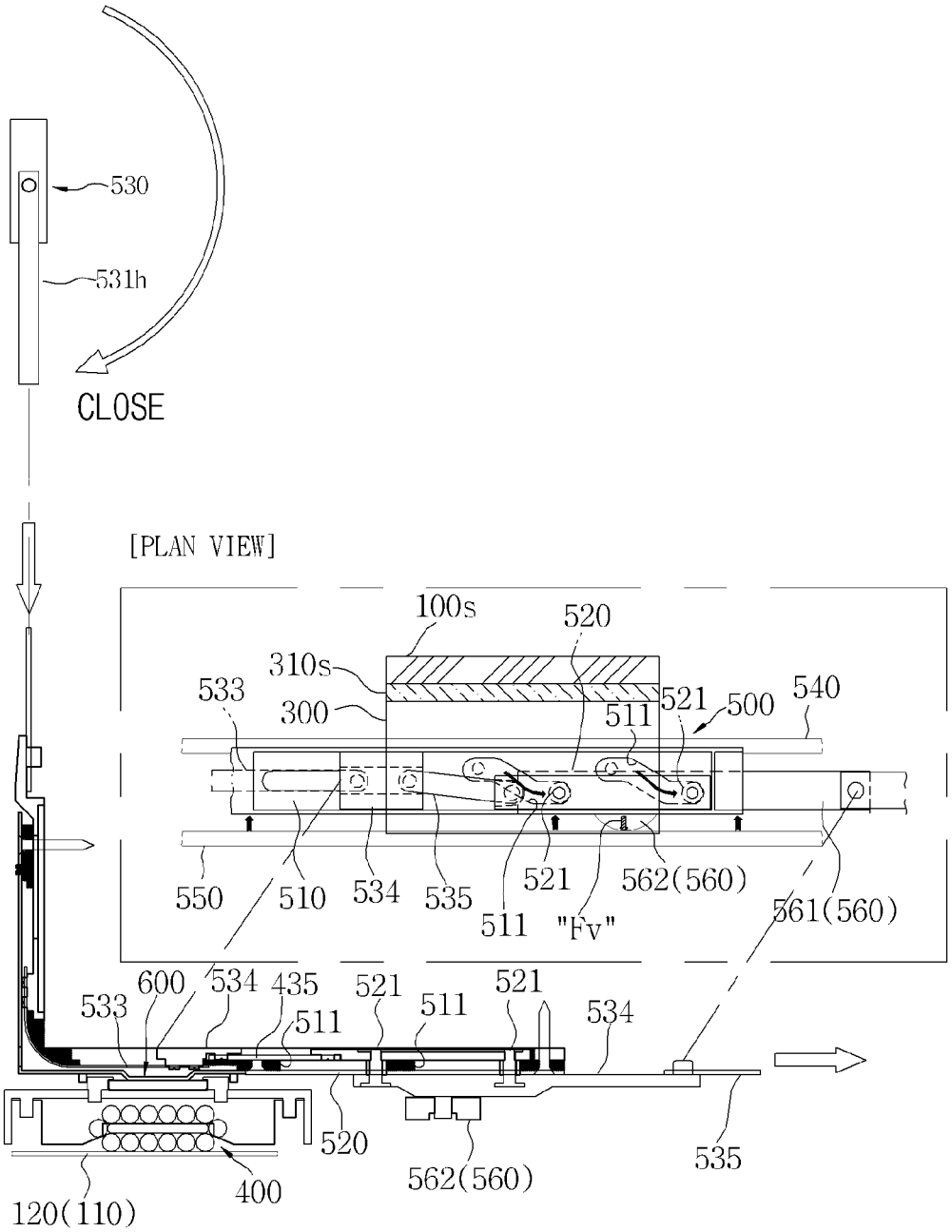
FIG. 26 is a side sectional view illustrating an operating state from FIG. 19 (unsealing state) to FIG. 20 (sealing state) which is viewed from the front side of the window frame.

In addition, the vertical sliding unit 600 will be described with reference to FIGS. 27 and 32 which are perspective views illustrating the detailed configuration of the vertical sliding unit, FIGS. 25 and 26 which are front and plan views illustrating the operating state of the vertical sliding unit 600, and FIGS. 28 to 41.

As illustrated in the above-described drawings, the vertical sliding unit 600 is provided between the roller device 400 and the moving window horizontal-moving device 500 such that no vertical component force is applied to the roller device 400 while the moving window 300 is slid for sealing in the vertical direction by the moving window horizontal-moving device 500.

The vertical sliding unit 600 may include: a flat plate member 610 provided on a bottom surface of the fixed frame 510 that constitutes the moving window horizontal-moving device 500; and a bearing unit 620 provided on a plane of the roller device 400 to be in contact with the plate member 610 and configured to slip only in a direction orthogonal to the longitudinal direction of the central rail 110.

Figure 27:
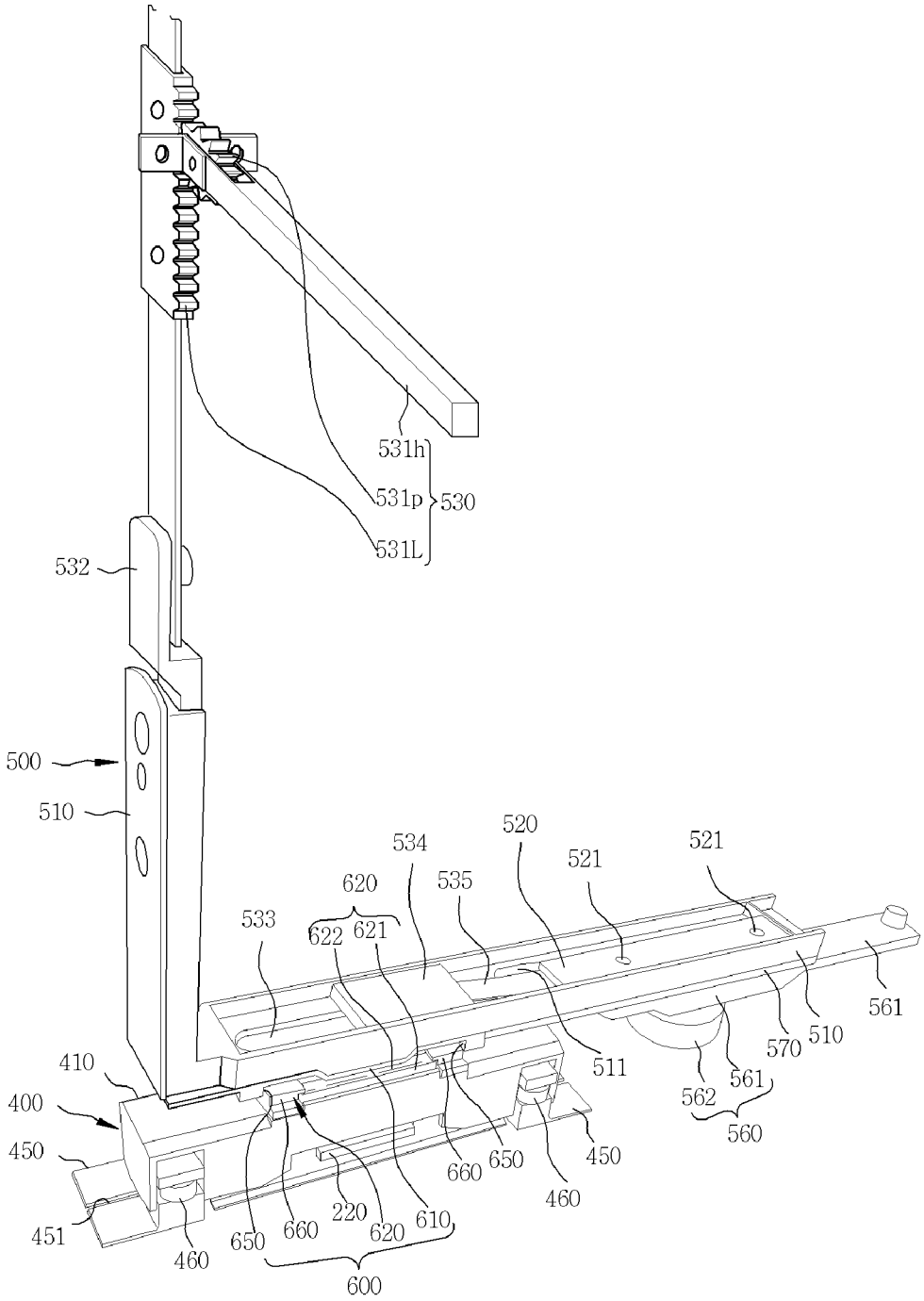
FIG. 27 is a perspective view illustrating a state in which the moving window horizontal-moving device is provided on the roller device in the moving window open/close apparatus of the sliding window system of the aluminum alloy sash structure according to an exemplary embodiment of the present invention.
Figure 28:
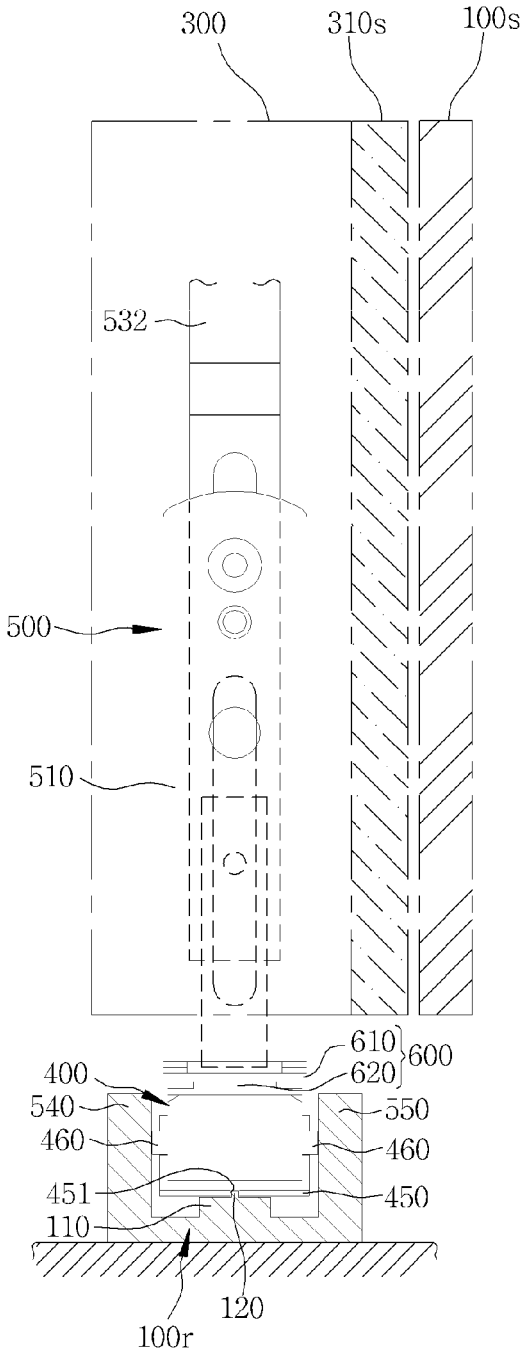
FIG. 28 is a side view illustrating a state in which the window frame fitted with the roller device and the moving window horizontal-moving device on the roller device are provided in the moving window open/close apparatus of the sliding window system according to an exemplary embodiment of the present invention, which is viewed in the direction where the roller device moves.
Figure 29:
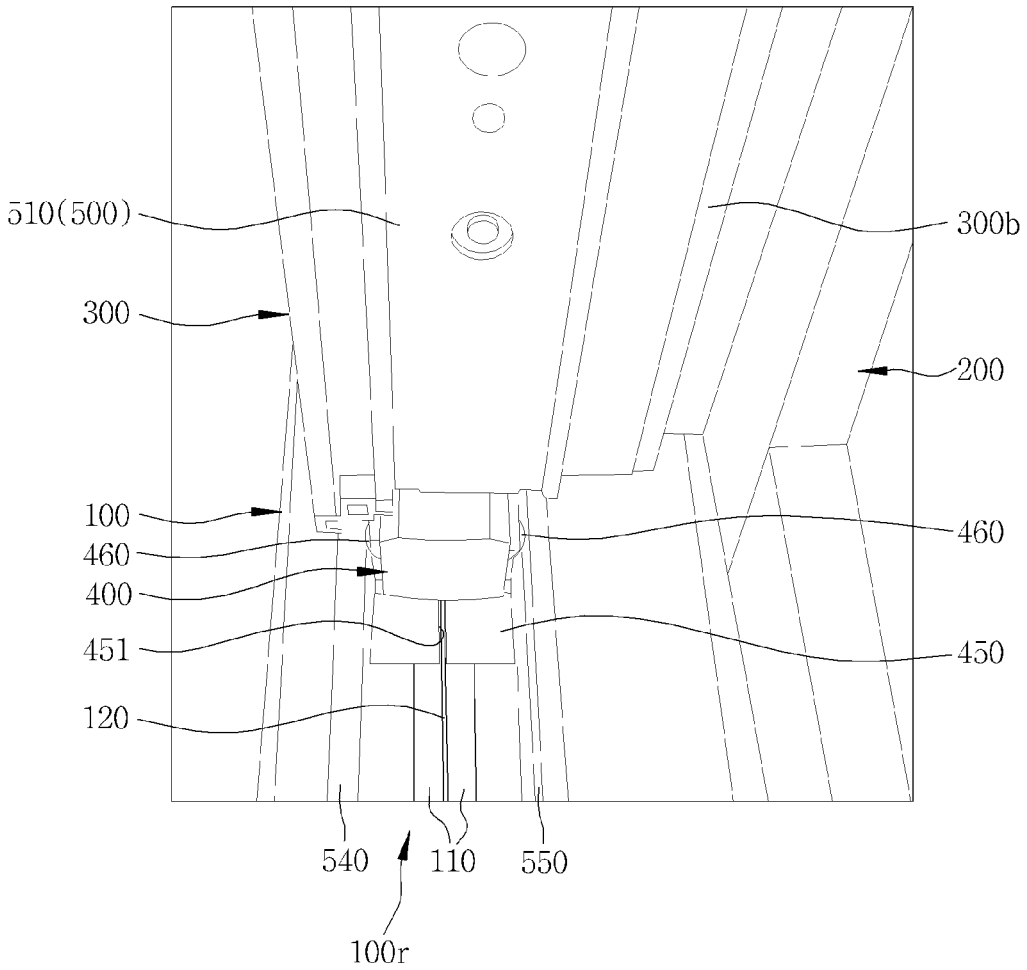
FIG. 29 is a schematic perspective view illustrating the moving window equipped with the moving window horizontal-moving device, the rolling device that supports the moving window, and the window frame fitted with the roller device in the moving window open/close apparatus of the sliding window system according to an exemplary embodiment of the present invention, which is viewed in the direction where the roller device moves.

FIG. 27 is a perspective view illustrating a state in which the moving window horizontal-moving device 500 is provided on the roller device in the moving window open/close apparatus of the sliding window system of the aluminum alloy sash structure according to an exemplary embodiment of the present invention, FIG. 28 is a side view illustrating a state in which the window frame 100 fitted with the roller device 400 and the moving window horizontal-moving device 500 on the roller device 400 are provided in the moving window open/close apparatus of the sliding window system according to an exemplary embodiment of the present invention, which is viewed in the direction where the roller device 400 moves, and FIG. 29 is a schematic perspective view illustrating the moving window 300 equipped with the moving window horizontal-moving device 500, the rolling device 400 that supports the moving window 300, and the window frame 100 fitted with the roller device 400 in the moving window open/close apparatus of the sliding window system according to an exemplary embodiment of the present invention, which is viewed in the direction where the roller device 400 moves.

Figure 30:
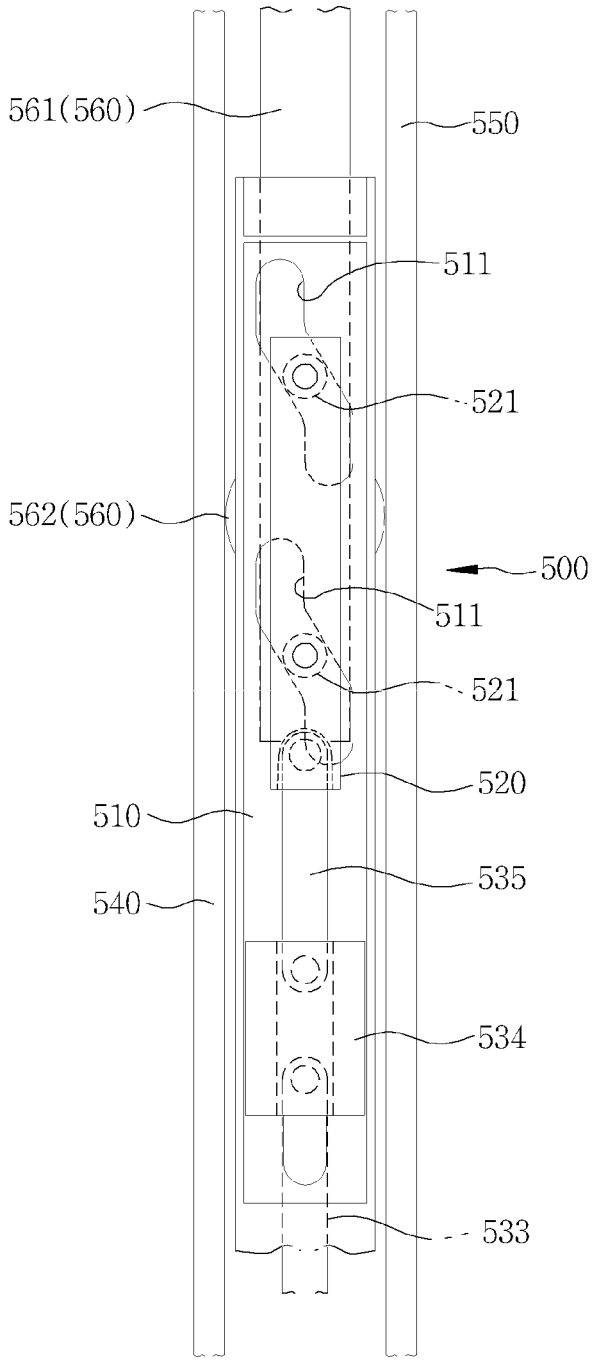
FIG. 30 is a plan view of FIG. 27.
Figure 31:
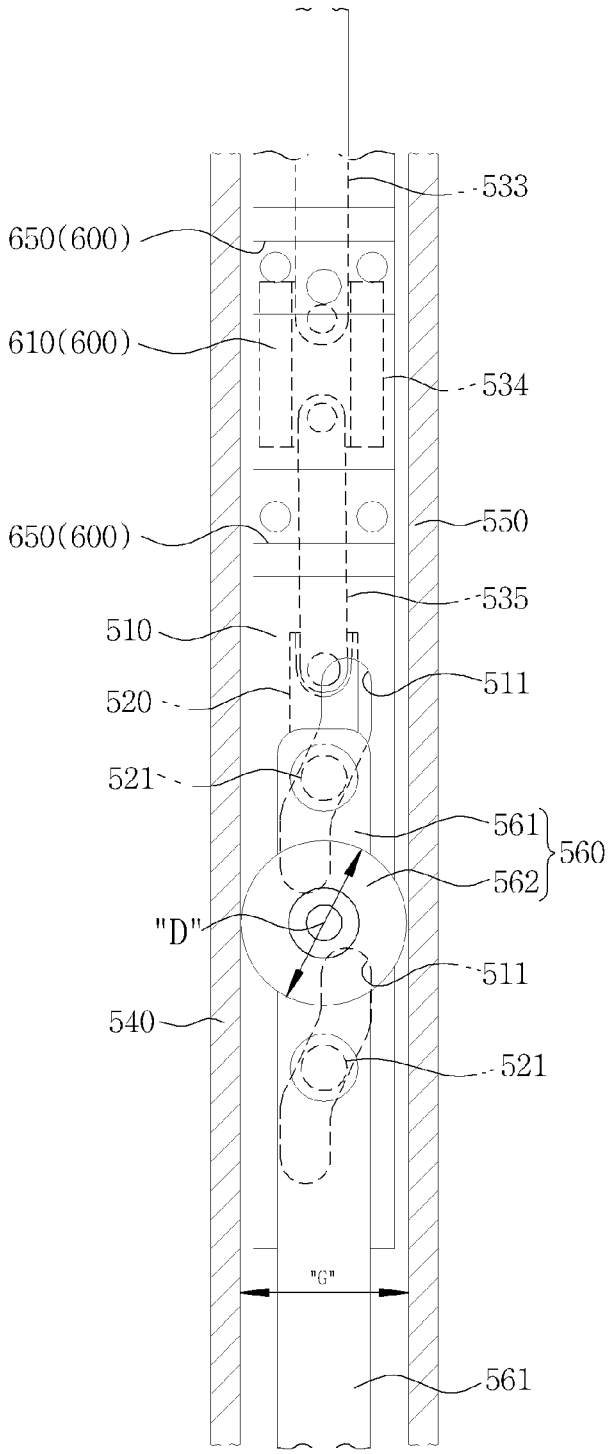
FIG. 31 is a bottom view illustrating the moving window horizontal-moving device in the moving window open/close apparatus of the sliding window system according to an exemplary embodiment of the present invention.

FIG. 30 is a plan view of FIG. 27, and FIG. 31 is a bottom view illustrating the moving window horizontal-moving device 500 in the moving window open/close apparatus of the sliding window system according to an exemplary embodiment of the present invention.

Figure 32:
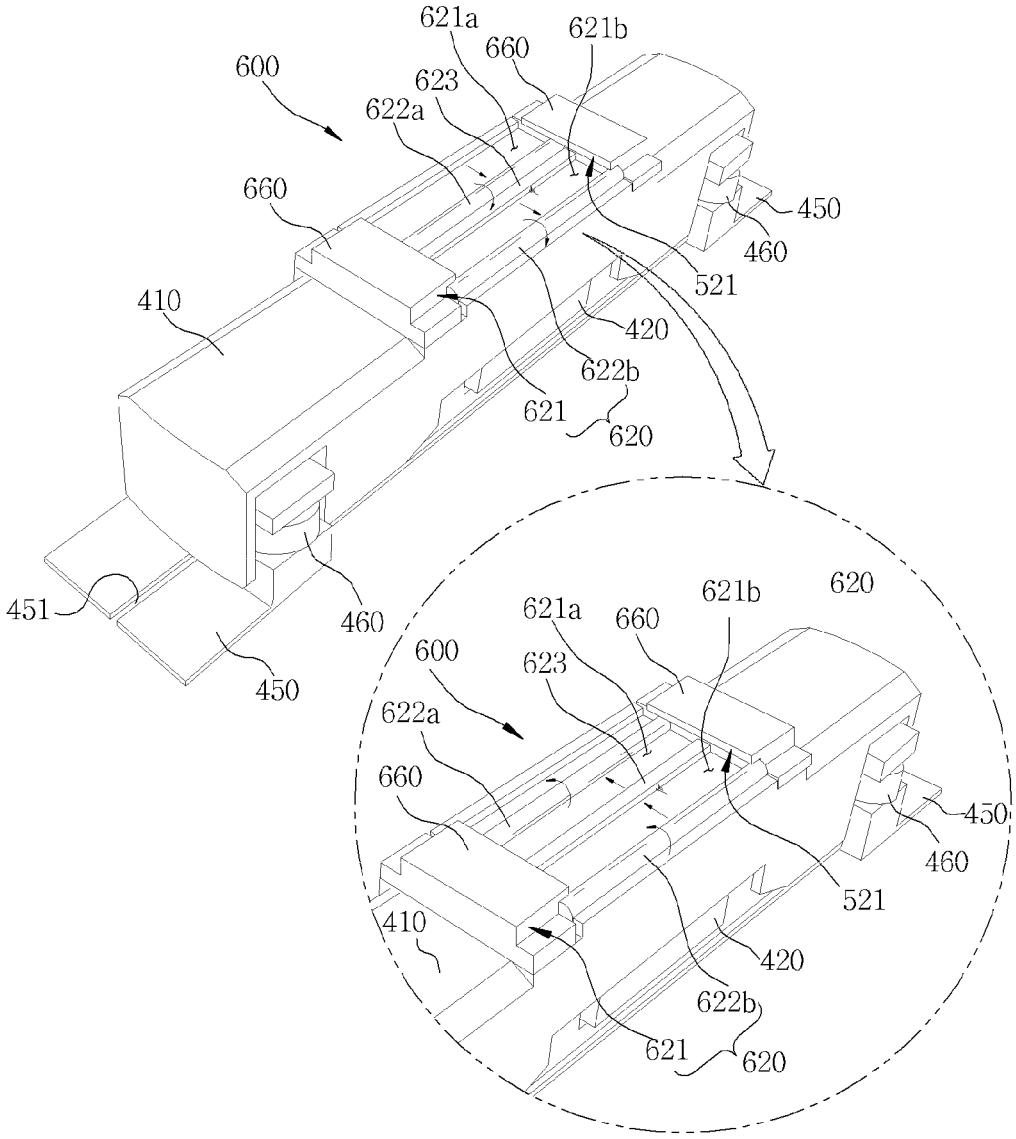
FIG. 32 is a perspective view illustrating the roller device and the vertical sliding unit in the moving window open/close apparatus of the sliding window system according to an exemplary embodiment of the present invention, which is viewed from an upper side.
Figure 33:
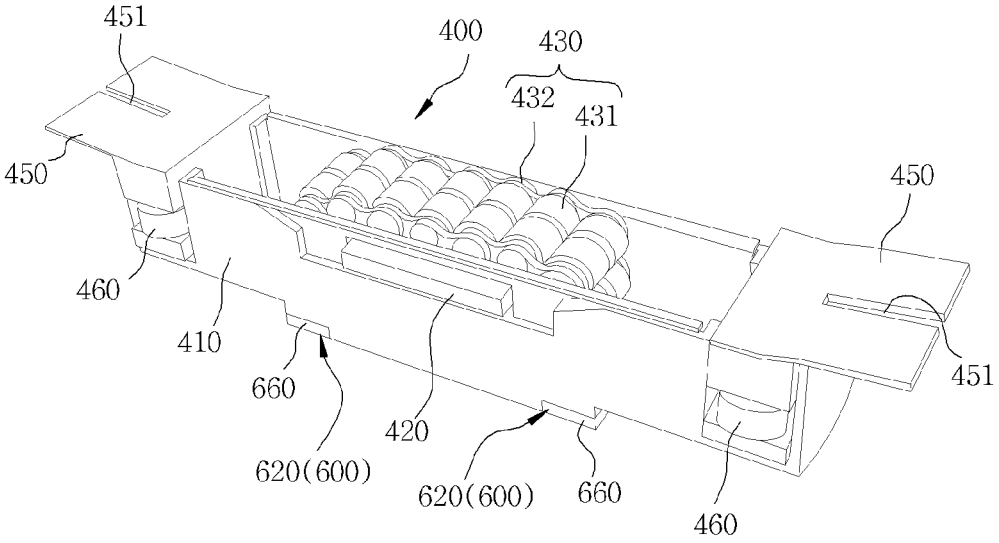
FIG. 33 is a perspective view illustrating the roller device of FIG. 32, which is viewed from a lower side.
Figure 34:
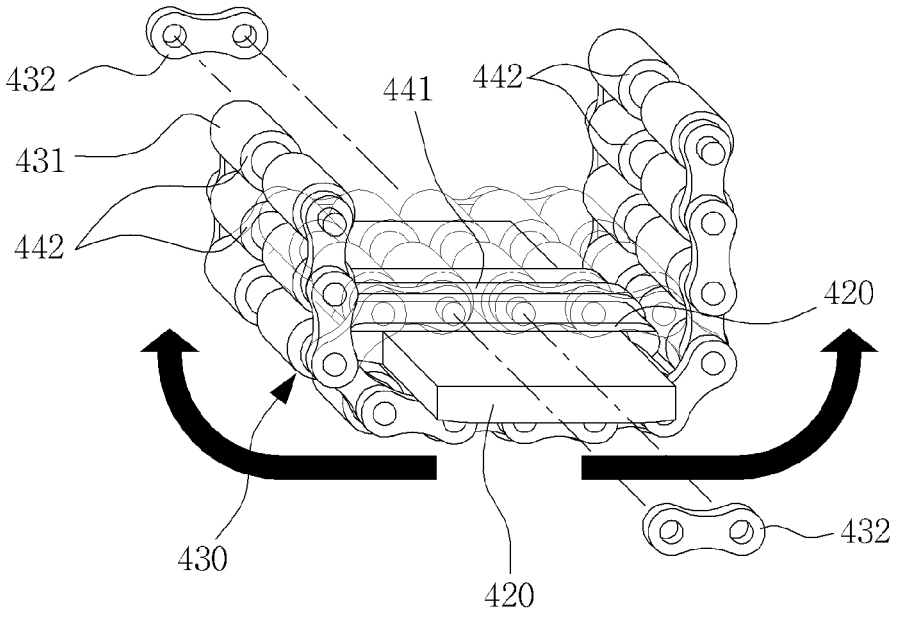
FIG. 34 is an assembly perspective view illustrating in detail the guide unit of the roller device of FIG. 32.

FIG. 32 is a perspective view illustrating the roller device 400 and the vertical sliding unit 600 in the moving window open/close apparatus of the sliding window system of the aluminum alloy sash structure according to an exemplary embodiment of the present invention, which is viewed from an upper side, FIG. 33 is a perspective view illustrating the roller device 400 of FIG. 32, which is viewed from a lower side, and FIG. 34 is an assembly perspective view illustrating in detail the guide unit 440 of the roller device 400 of FIGS. 32 and 33.

Figure 35:
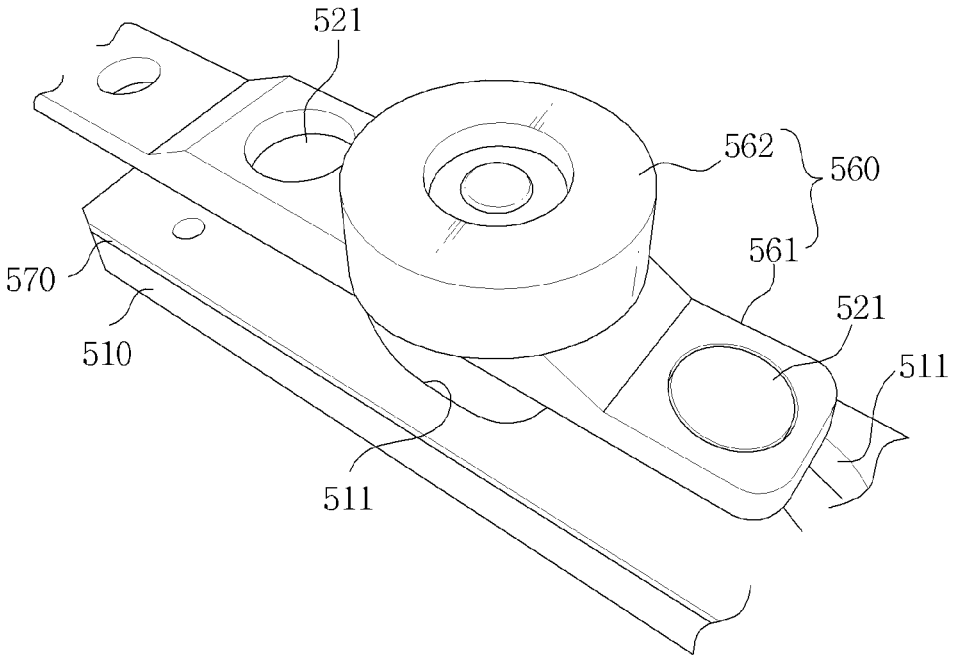
FIG. 35 is a perspective view illustrating a state where the circular compression roller is rotatably provided on the support member in the moving window open/close apparatus of the sliding window system according to an exemplary embodiment of the present invention, which is viewed from a lower side.

FIG. 35 is a perspective view illustrating a state where the circular compression roller 562 is rotatably provided on the support member 561 in the moving window open/close apparatus of the sliding window system according to an exemplary embodiment of the present invention, which is viewed from a lower side.

The moving window open/close apparatus of the sliding window system according to an exemplary embodiment of the present invention includes a window frame 100, a roller device 400, a moving window 300, a moving window horizontal-moving device 500, and a vertical sliding unit 600, as illustrated in FIGS. 27 to 35. Hereinafter, each constituent element will be described in detail.

As illustrated in FIG. 29, the window frame 100 is installed in an opened wall of a building in a rectangular loop shape, and the moving window 300 is movably provided in the window frame 100. The window frame 100 includes an inner frame 100*a* and an outer frame 100*b* which are made of an aluminum alloy material with a high heat conductivity, and a thermal break 100*c*1 interconnecting the inner and outer frames and made of a synthetic resin material. A rail guide 100*r* is provided in the horizontal direction on the top surface of the bottom portion.

In addition, a moving window sealing frame 100*d* made of an aluminum alloy material as described above is provided in a rectangular loop shape in the moving window closing region within the outer frame 100*b* of the window 100 to interconnect the inner frame 100*a* and the outer frame 100*b* in which a first thermal break sealing member 100*s* which may be made of a synthetic resin material is provided on the front surface of the moving window sealing frame 100*d*.

Such a window frame 100 includes a rail guide 100*r* so as to allow the moving window 300 to be smoothly moved. In particular, the rail guide 100*r* may include a central rail 110 on which the bottom surface of the roller device 400 under the moving window 300 may be directly abutted.

Figure 1:
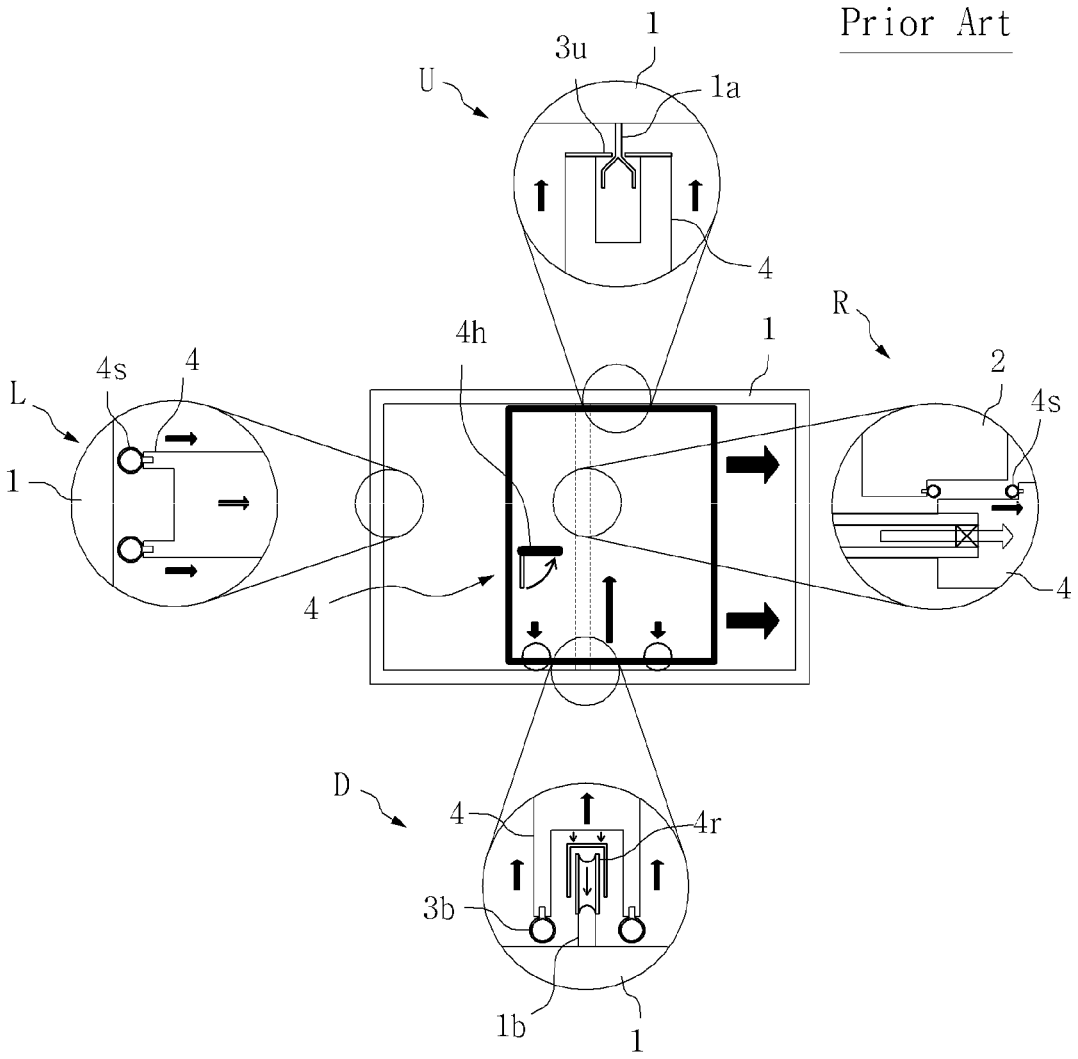
FIGS. 1 to 3 are views illustrating a conventional configuration of a sliding window system.
Figure 2:
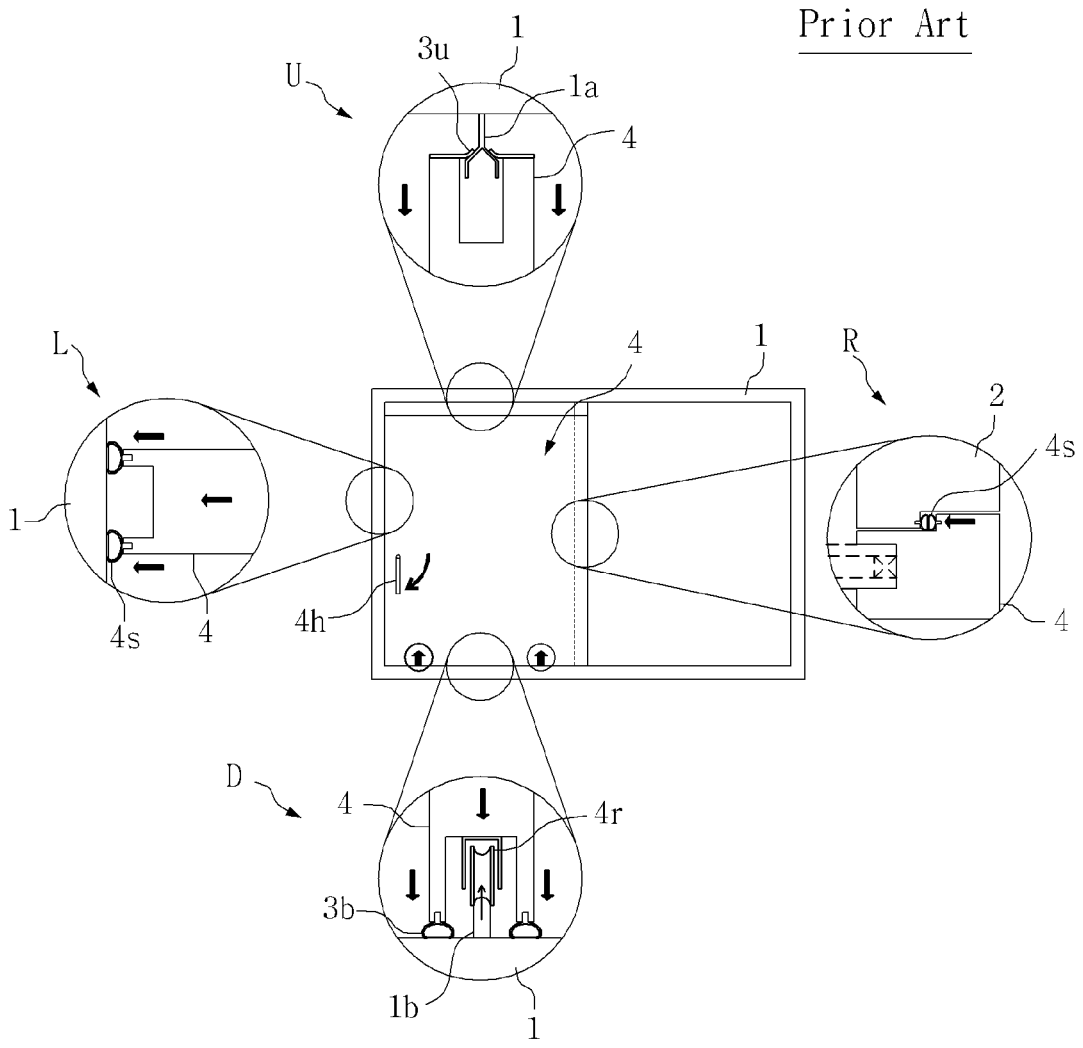
Figure 3:
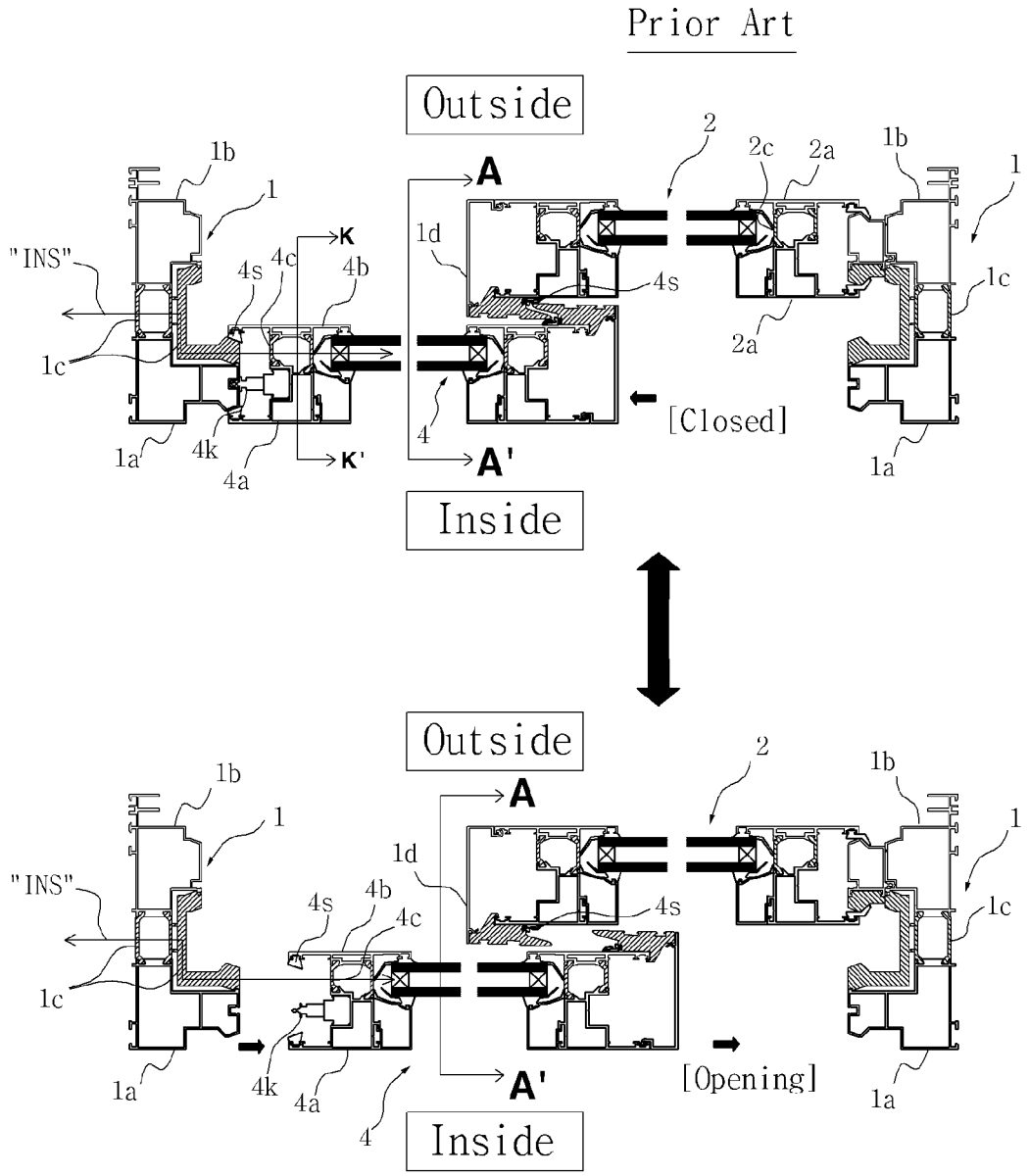
Figure 4:
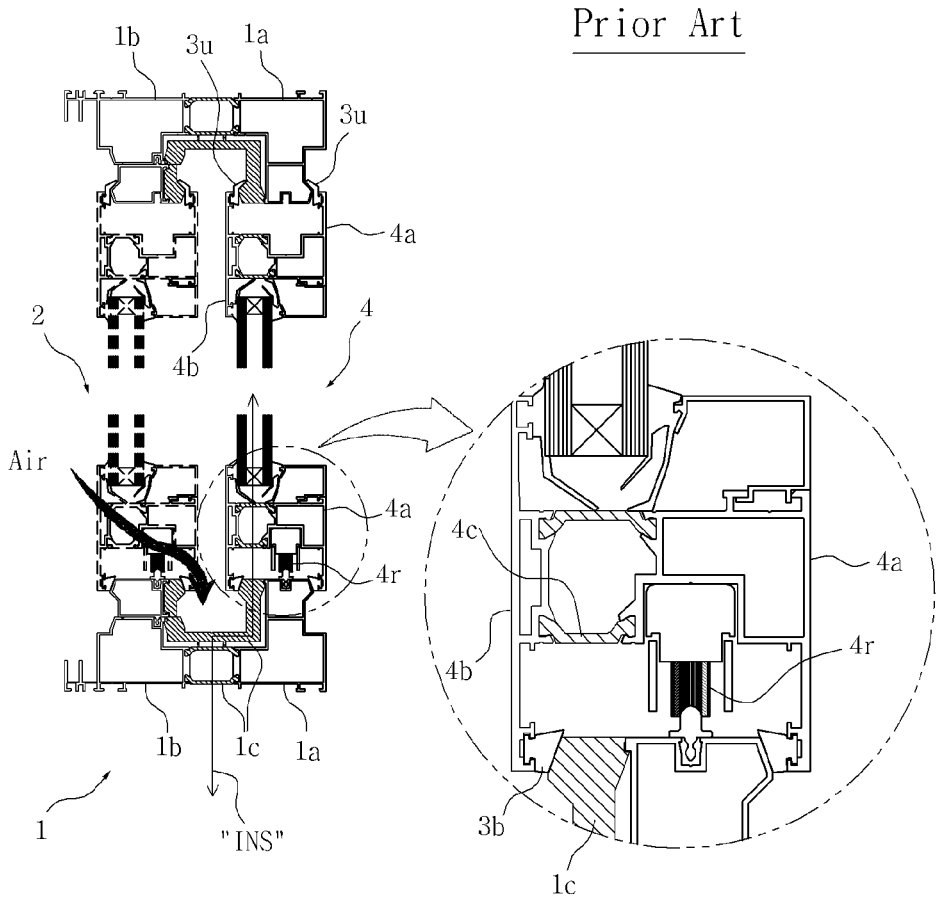
FIGS. 4 and 5 are views illustrating a horizontal sliding window system according to a conventional lift and sliding type.
Figure 5:
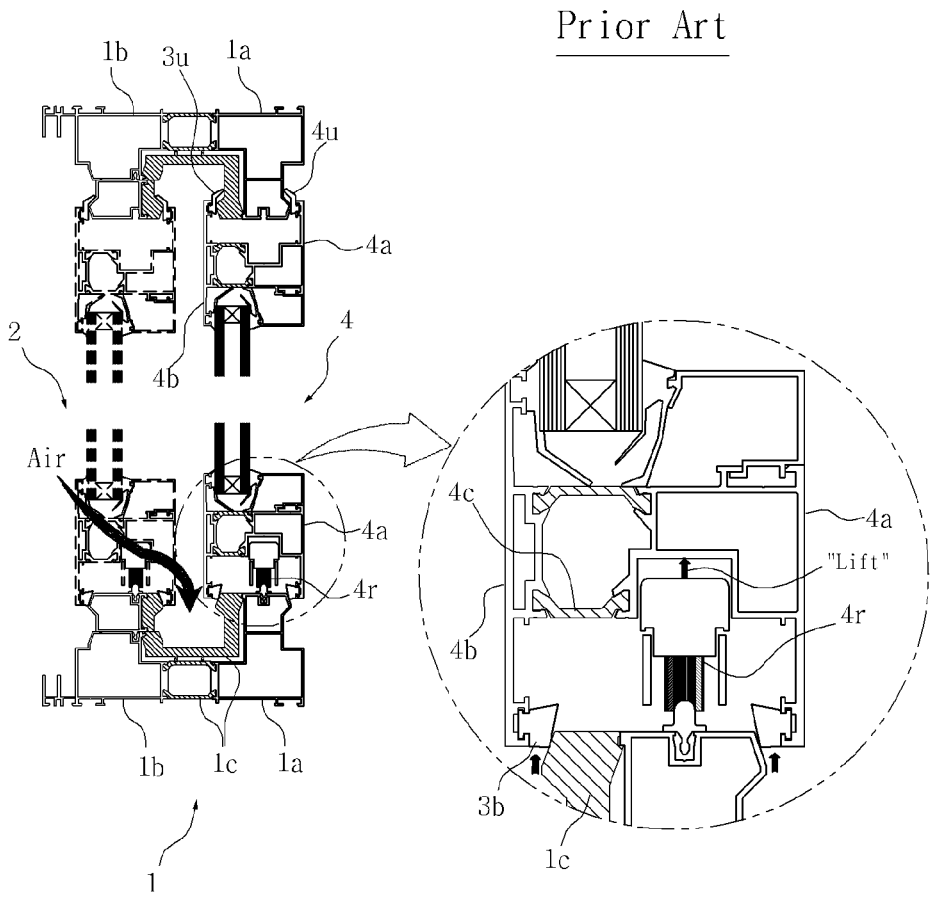
Figure 6:
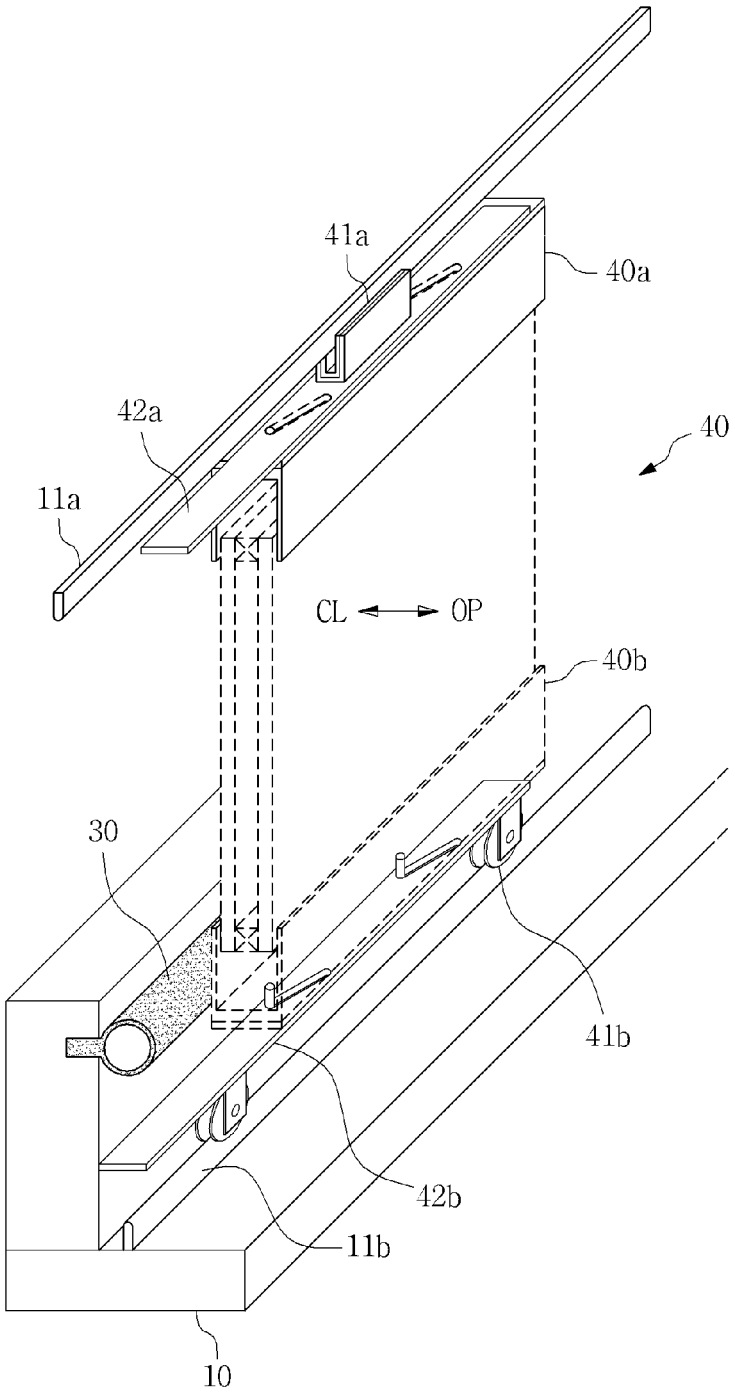
FIG. 6 is a perspective view schematically illustrating a moving window open/close apparatus of a conventional sliding window system.
Figure 7:
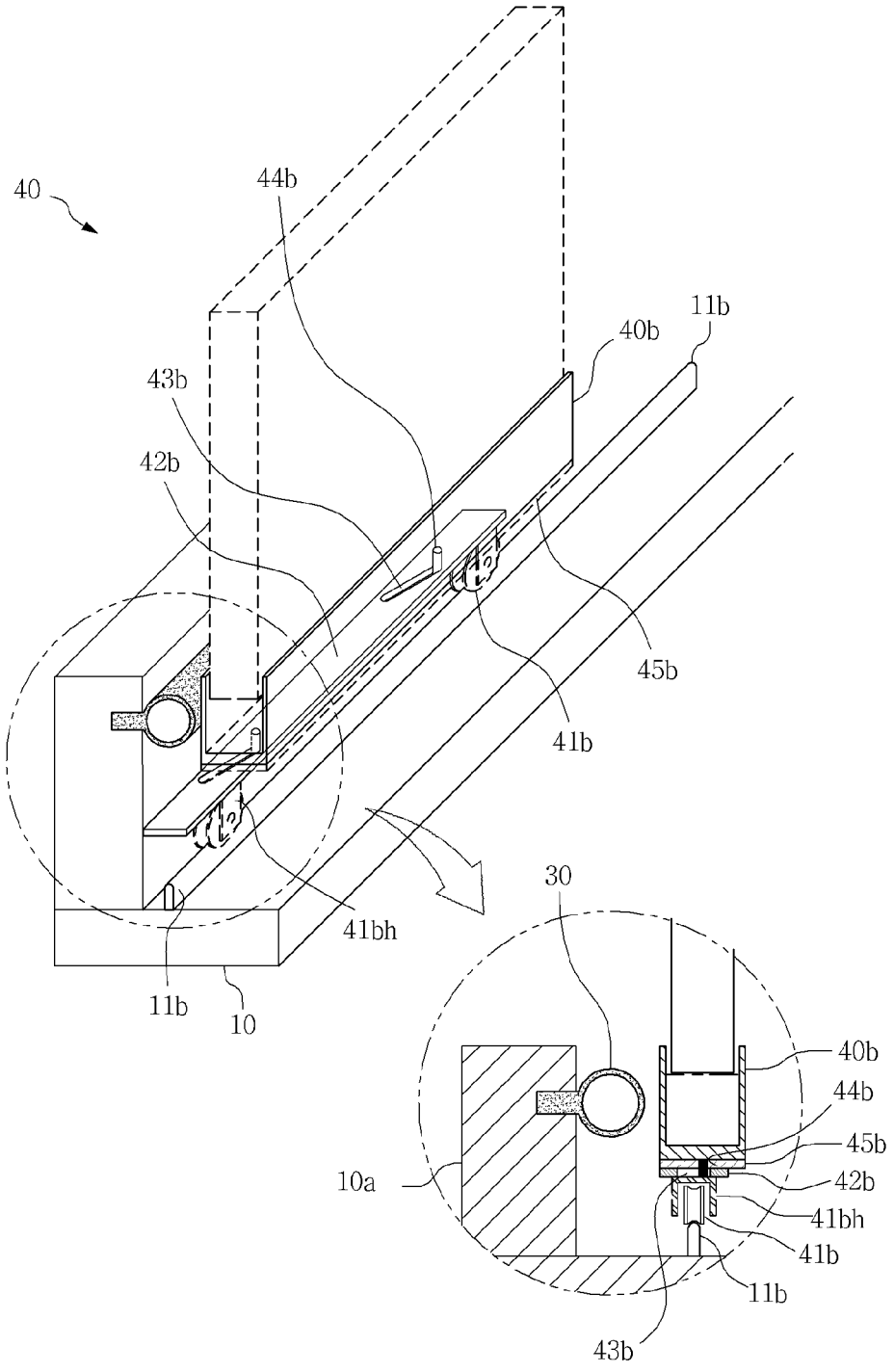
FIG. 7 is a perspective view illustrating a main portion of the moving window before the moving window is moved in the direction orthogonal to the rail travel direction in the moving window open/close apparatus of the sliding window system of FIG. 6.
Figure 8:
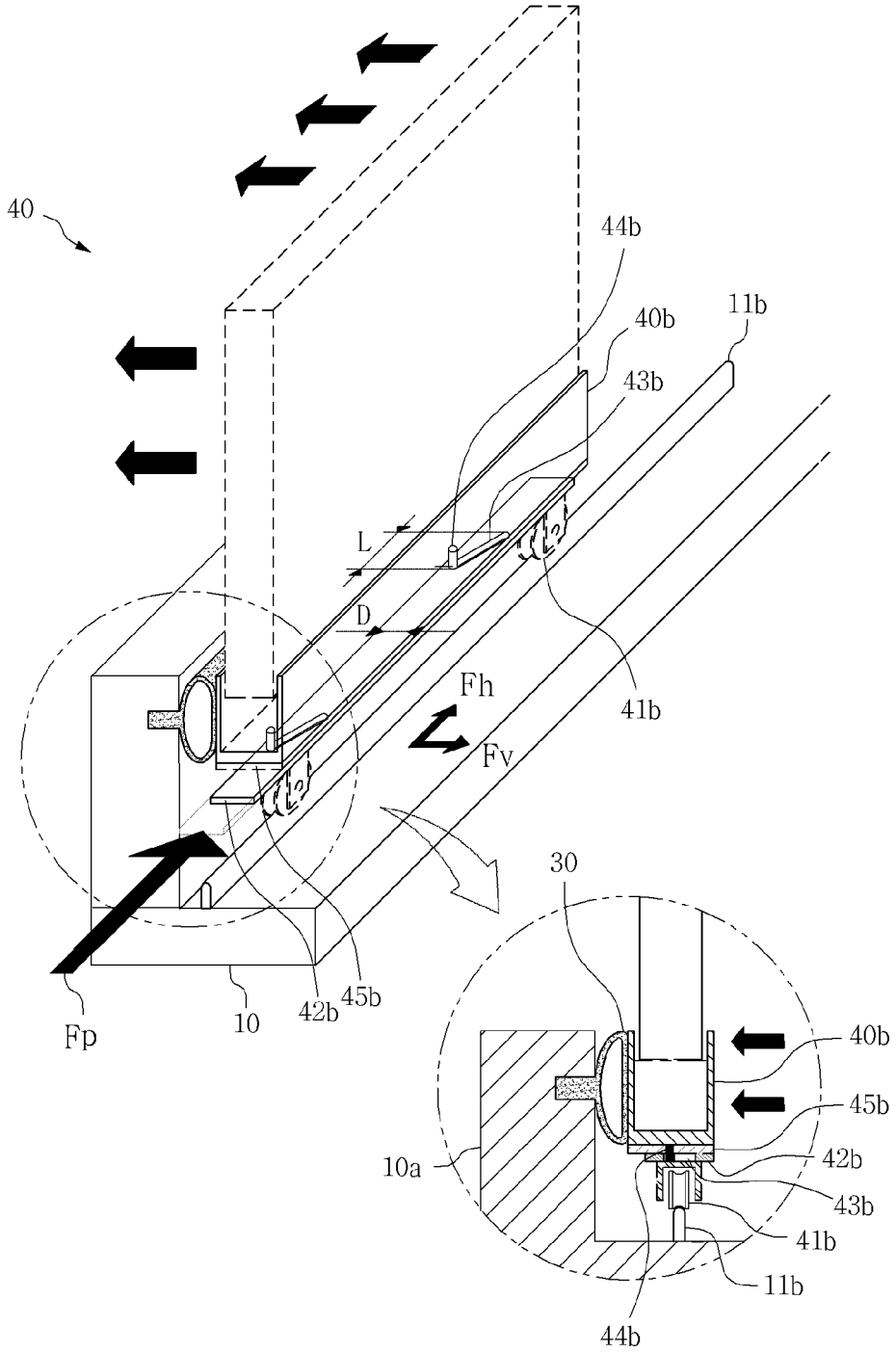
FIG. 8 is a perspective view illustrating the main portion of the moving window after the moving window is moved in the direction orthogonal to the rail travel direction to compress the sealing member in the moving window open/close apparatus of the sliding window system of FIG. 6.
Figure 9:
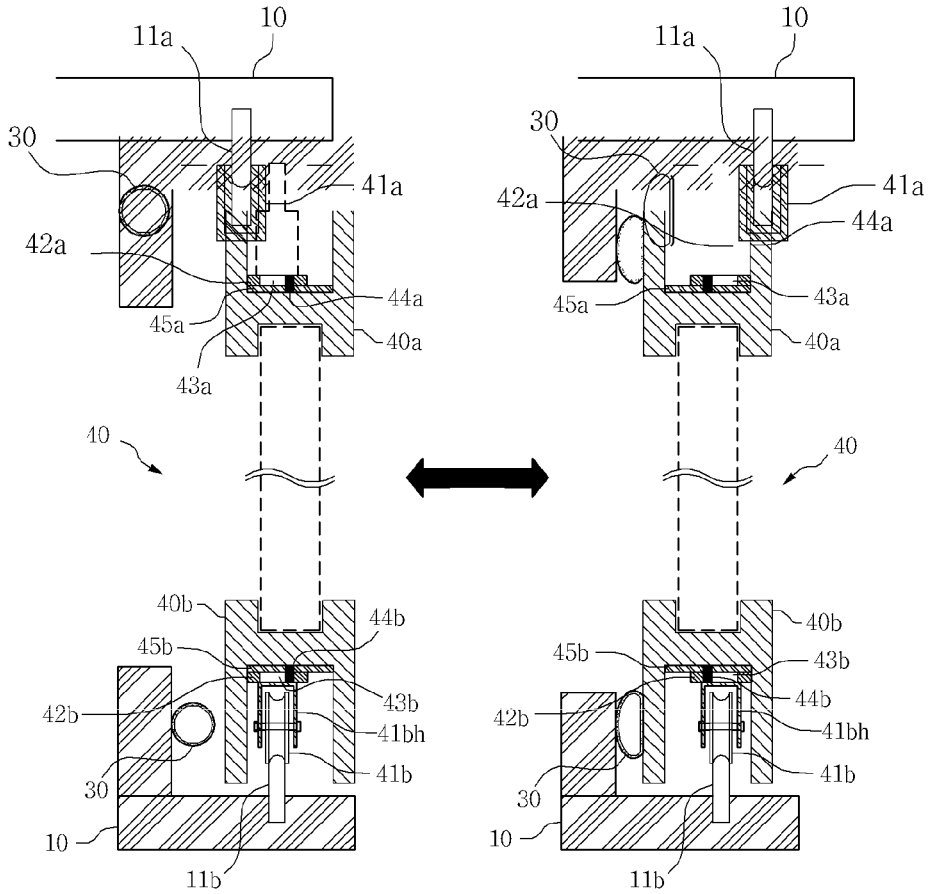
FIGS. 9*a* and 9*b* are vertical section views illustrating an opened state before the moving window is moved in the direction orthogonal to the rail travel direction and a closed state after the moving window is moved in the direction orthogonal to the rail travel direction in the moving window open/close apparatus of the sliding window system of FIG. 6.
Figure 10:
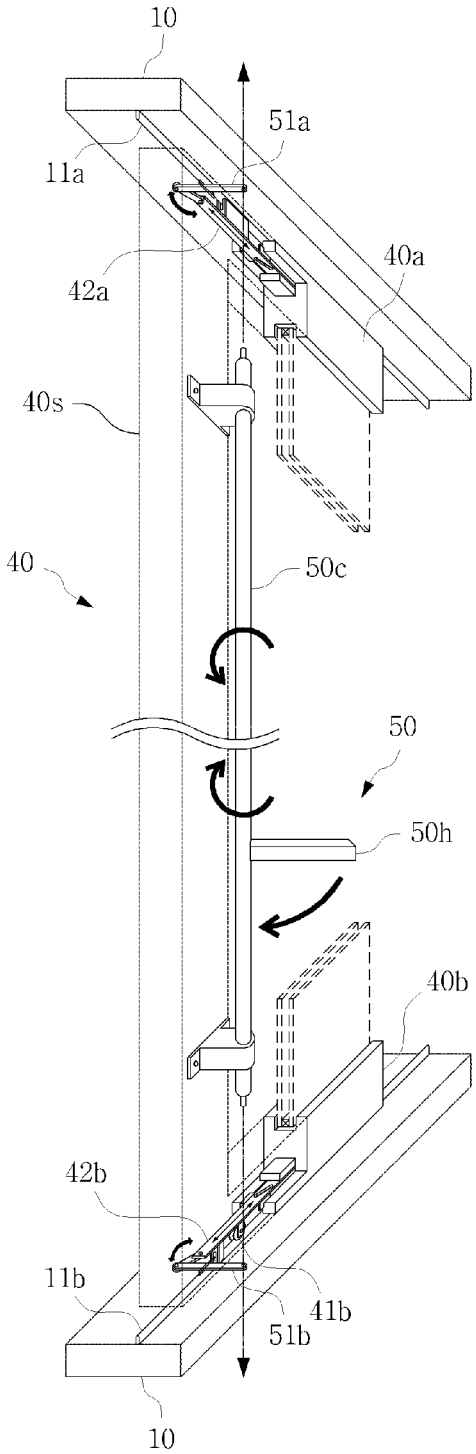
FIG. 10 is a perspective view illustrating a moving window horizontal-moving device in the open/close operation unit in the moving window open/close apparatus of the conventional sliding window system.
Figure 11:
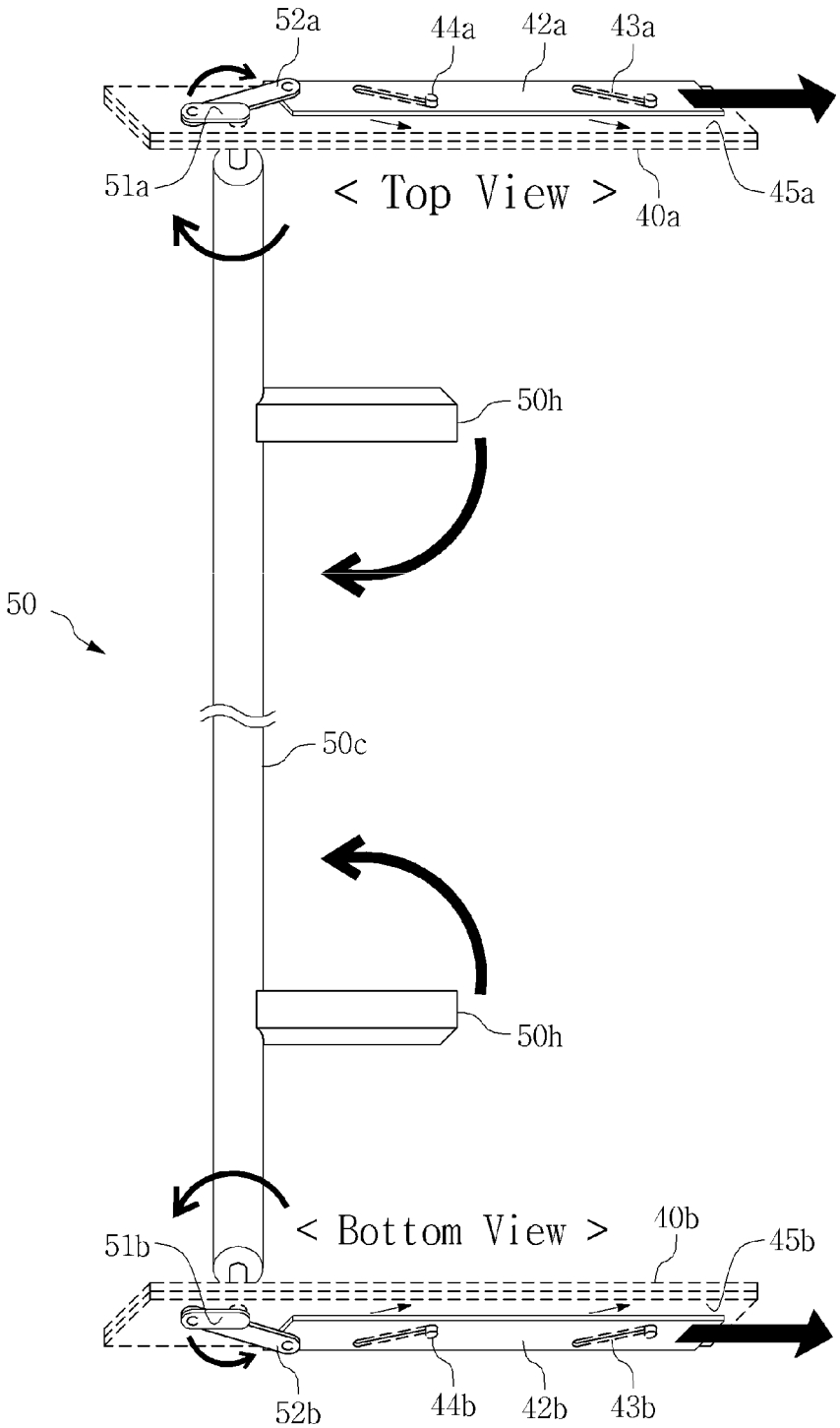
FIG. 11 is a perspective view illustrating a main configuration and an operating state in the main portion of FIG. 10.
Figure 12:
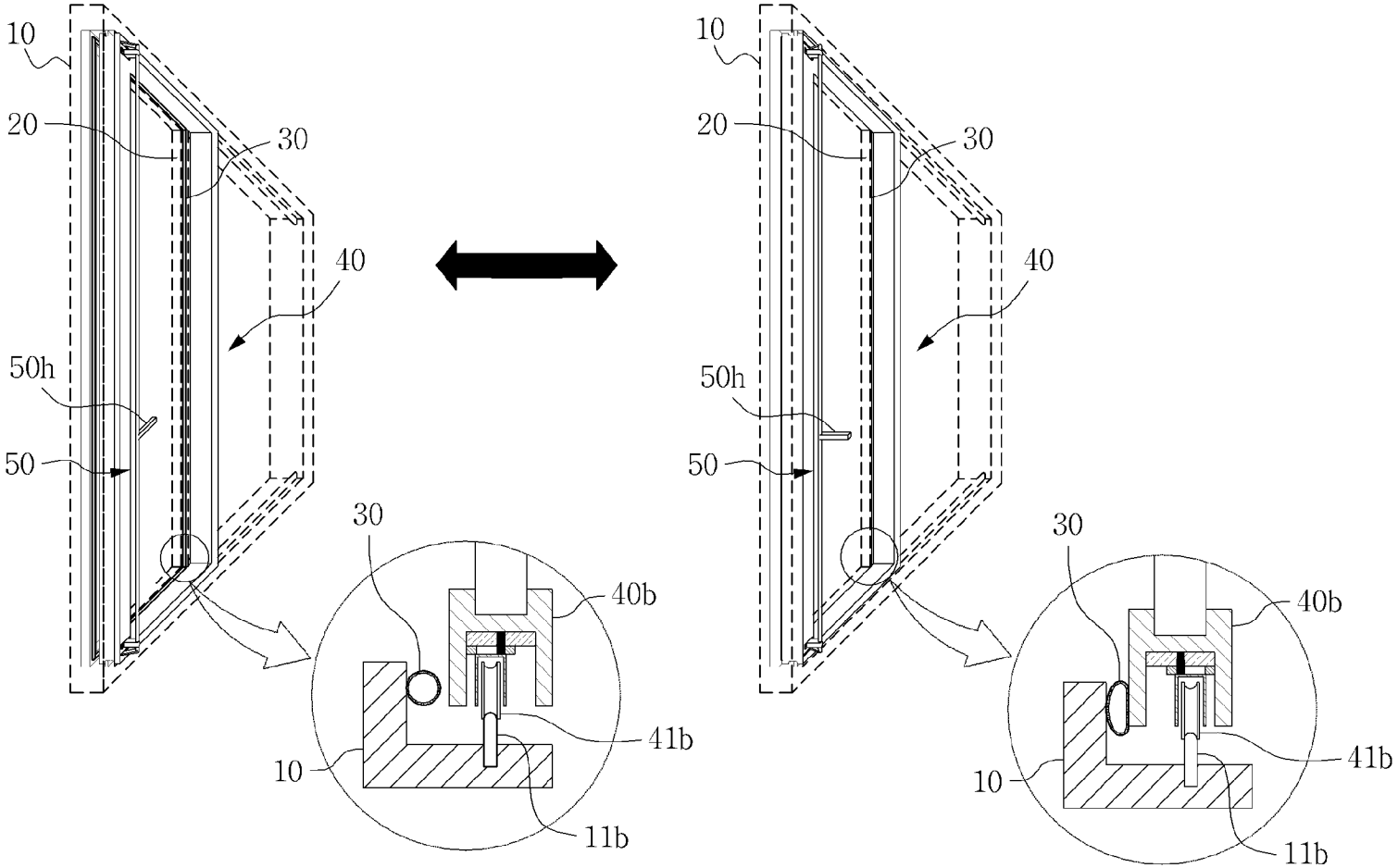
FIG. 12 is a view illustrating states before and after the moving window is moved in the direction orthogonal to the longitudinal direction of the rail in the moving window open/close apparatus of the sliding window system to which the open/close operation unit of FIG. 10 is applied.
Figure 13:
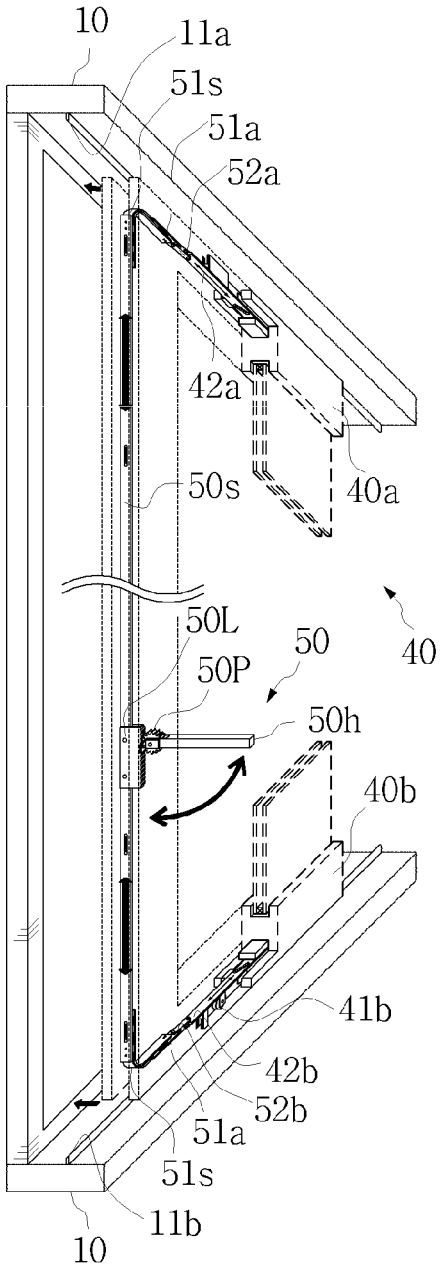
FIG. 13 is a view illustrating an open/close operation drive unit (open/close operation unit) of another type.
Figure 14:
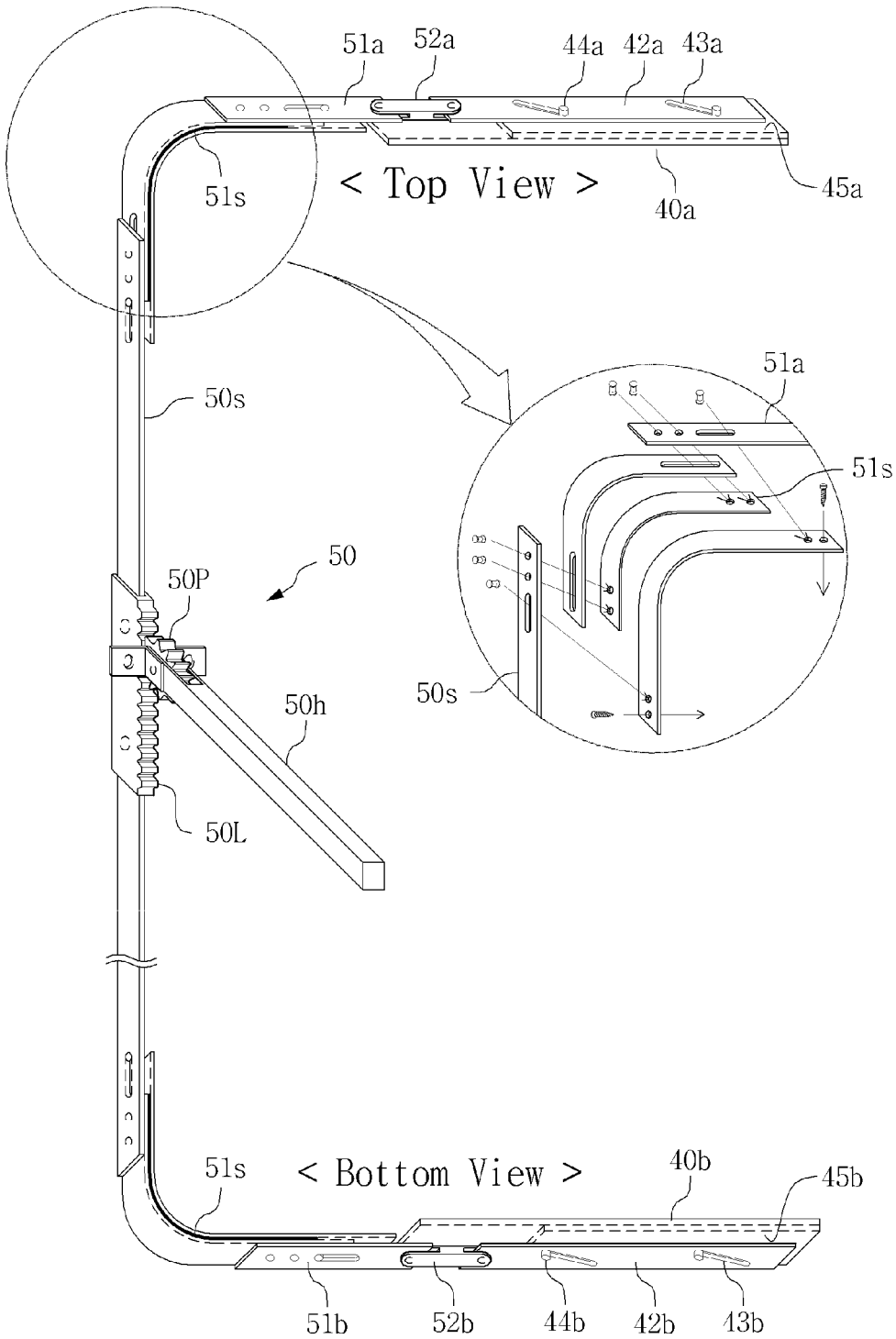
FIG. 14 is a view illustrating a main configuration and an operating state of the open/close operation unit illustrated in FIG. 13.

As illustrated in FIG. 29 and FIGS. 32 to 34, roller device 400 serves as a wheel of the moving window 300 such that the moving window 300 can move smoothly along the central rail 110. In particular, the bottom surface of the moving window 300 is laid on the top plane of the roller device 400, and a vertical sliding unit 600 to be described later is provided between the moving window horizontal-moving device 500 and the roller device 400 such that a vertical component force (see "Fv" in FIG. 3) is not transferred to the roller device 400.

The moving window horizontal-moving device 500 is fixed to the moving window 300 as illustrated in FIG. 29, and is configured to slide the moving window 300 in the horizontal direction which is orthogonal to the longitudinal direction of the central rail 110 (i.e., the rail travel direction) as illustrated in FIGS. 27, 30 and 31. The reason why the moving window 300 is slid in the horizontal direction orthogonal to the longitudinal direction of the central rail 110 (rail travel direction) as described above is to move the moving window 300 toward the window frame 100 (or the fixed window 200) to seal the gap therebetween, thereby obtaining an excellent performance with respect to a soundproof property, an airtight property, a watertight property, a heat insulation property, a wind pressure resistance property, or the like as already described in the "Background Art" section. In particular, for this sealing, as illustrated in FIG. 29, between the moving window sealing frame 100*d* arranged in a rectangular loop shape within the window frame 100 and the moving window 300, a first thermal break sealing member 100*s* which may be made of a synthetic resin material, and a second thermal break sealing member 310*s* with a predetermined elasticity, which is provided on the rear surface of the moving window 300, are provided to be in contact with the first thermal break sealing member 100*s* of the moving window sealing frame 100*d*.

The moving window horizontal-moving device 500 will be described in detail below.

As illustrated in FIGS. 27, 31 and 32, the vertical sliding unit 600 is provided between the roller device 400 and the moving window horizontal-moving device 500 such that a vertical component force (see "Fv" in FIG. 3) is not applied to the roller device 400 while the moving window 300 is slid for sealing in the vertical direction by the moving window horizontal-moving device 500.

In particular, the vertical sliding unit 600 is provided so as to prevent the vertical component force (see "Fv" in FIG. 3) from being transferred to the roller device 400 even if the vertical component force (see "Fv" in FIG. 3) is applied to the moving window 300 and the movable frame 520 to be described later.

For this purpose, as an example, the vertical sliding unit 600 may include a flat plate member (see "610" in FIG. 31), and a bearing unit (see "620" in FIG. 32). The flat plate member 610 is provided on the bottom surface of the fixed frame 510 which is one element of the moving window horizontal-moving device 500, and the bearing unit 620 is provided on the top plane of the roller device 400 to be in contact with the bottom surface of the plate member 610 to have a configuration that allows the plate member 610 to slip in the direction orthogonal to the longitudinal direction of the central rail 110. Accordingly, the flat plate member 610 may slip from the bearing unit 620 substantially in the vertical direction. Of course, the "vertical direction" used here is defined in consideration of the fact that the members laid on the bearing unit 620 (in particular, the moving window 300) may be slightly distorted left and right.

More specifically, in order to make the flat plate member 610 slip in the vertical direction from the bearing unit 620, the bearing unit 620 may include a bearing mount 621 provided on the top plane of the housing 410 of the roller device 400, and one or more pin type roller bearings 622*a* and 622*b* which are arranged in the bearing mount 621 to have the same longitudinal direction as the longitudinal direction of the central rail 110, as illustrated in FIG. 32. As a result, because the long pin type roller bearings 622*a* and 622*b* are provided and arranged as described above, the rolling movement direction of the pin type roller bearings 622*a* and 622*b* is determined to the direction substantially orthogonal to the longitudinal direction of the central rail 110.

In addition, in order for the bearing unit 620 to properly support the plate member 610 laid thereon, as illustrated in FIG. 31, the bearing unit 620 may further include a separation plate 623 placed at the middle of the bearing mount 621 to separate the bearing mount 621 into first and second areas 612*a* and 612*b*, and the one or more pin type roller bearings 622*a* and 622*b* may include a first pin type roller bearing 622*a* which is laid in the first area 621*a* to be movable in the vertical direction (see arrows in FIG. 31), and a second pin type roller bearing 622*b* which is laid in the second area to be movable in the vertical direction (see arrows in FIG. 32). Accordingly, the plate member 610 laid on the bearing unit 620 is properly supported by the first and second pin type roller bearings 622*a* and 622*b* to be smoothly slidable together with the first and second pin type roller bearings 622*a* and 622*b* in the directions indicated by the arrows in FIG. 32.

Meanwhile, as illustrated in FIGS. 27, 31 and 32, an engagement structure of an engagement step 650, which is provided on the bottom surface of the fixed frame 510, and an engagement step 660 (see FIG. 27), which is formed on the plane of the roller device 400 to be engaged with the engagement step 650 (see FIGS. 27 and 32), is provided between the fixed frame 510 and the roller device 400 such that while the moving window 300 is moved along the longitudinal direction of the central rail 110 (i.e., the rail travel direction), the roller device 400 is also moved integrally with the moving window 300. The engagement structure of the engagement step 650 and the engagement step 660 serves to allow the moving window 300 to move in the longitudinal direction of the central rail 110 without disturbing the role of the above-described vertical sliding unit 600. That is, while the moving direction of the moving window 300 is changed to the vertical direction by the moving window horizontal-moving device 500, the engagement structure prevents a vertical component force (see "Fv" in FIG. 3) from being applied to the roller device 400 so that the role of the vertical sliding unit 600 is not disturbed. On the other hand, while the moving window 300 moves along the longitudinal direction of the central rail 110, the engagement structure allows the roller device 400 to be moved integrally with the roller device 400.

As a more specific exemplary embodiment for this, when the bearing mount 621 of the above-described vertical sliding unit 600 has a structure protruding from the top plane of the housing 3410 of the roller device 400 as illustrated in FIG. 32, the engagement step 650 may be stepped portions at the opposite ends of the bearing mount 621 (i.e., the front and rear ends of the bearing mount 621 with reference to the rail travel direction) (see FIG. 27), in which case the engagement step 660 may be formed at the opposite ends of the flat plate member 610 to correspond to the stepped portions (i.e., the front and rear ends of the plate member 610 with reference to the rail travel direction) (see FIG. 32).

Hereinafter, the moving window horizontal-moving device 500 will be described in more detail with reference to FIGS. 27 to 31.

The moving window horizontal-moving device 500 is a device that changes the moving direction of the moving window 300 from the direction which is the same as the longitudinal direction of the central rail 110 (i.e., rail travel direction) to the vertical direction orthogonal to the longitudinal direction. The moving window horizontal-moving device 500 may include a fixed frame 510 including a first inclined guide member (e.g., inclined guide slot), a movable frame 520 including a second inclined guide member (i.e., guide protrusion), an open/close operation drive unit 530, a front support rail 540, a rear support rail 550, and a compression unit 560. Hereinafter, each of the constituent elements will be described in more detail.

As illustrated in FIG. 29, the fixed frame 510 is completely fixed to the entirety or a part of the peripheral surface of the moving window 300, and moved together with the moving window 300 when the moving window 300 is moved. In addition, as in the exemplary embodiment illustrated in FIG. 30, the inclined guide slot 511 is formed on the fixed frame 510 as the first inclined guide member to be inclined by a set angle in relation to the longitudinal direction of the central rail 110. In particular, the guide protrusion 521 formed on the movable frame 520 is inserted into the inclined guide slot 511. When the movable frame 520 is moved by the open/close operation drive unit 530, the guide protrusion 521 is moved along the inclined guide slot 511, and during the movement, the compression unit 560 provided on the movable frame 520 pushes a front support rail 540 (or a rear support rail 550) to be described later. While the front support rail 540 (or the rear support rail 550) is pushed, the fixed frame 510 and the moving window 300 fixed thereto is moved in a direction orthogonal to the rail travel direction. That is, the moving direction of the moving window 300 is changed from the rail travel direction to the direction orthogonal to the rail travel direction. For reference, because the mechanical relationship between the inclined guide slot 511 and the guide protrusion 521 are illustrated and described in detail in FIGS. 6 to 9 and the "Background Art" section, the detailed description thereof will be omitted.

Of course, the shape of the inclined guide slot 511 may be implemented variously as disclosed FIGS. 26a to 29b in Korean Patent No. 10-0729222 (FIGS. 56 to 66 in PCT Publication No. WO 2007/075075) as mentioned in the "Background Art" section.

In addition, according to another exemplary embodiment of the present invention, it is natural that the forming positions of the guide protrusion 521 and the inclined guide slot 511 may be interchanged. That is, although not illustrated in the drawings, the guide protrusion may be formed on the fixed frame 510, and the inclined guide slot may be formed on the movable frame 520 which is equivalent to the exemplary embodiments exemplified in the drawings.

The movable frame 520 is positioned between the fixed frame 510 and the moving window 300, and as illustrated in FIGS. 27 and 30, slidably provided on the fixed frame 510. In addition, the guide protrusion 52 provided to be movable along the above-described inclined guide slot 511 is formed on the movable frame 520 as the second inclined guide member. The functions of the inclined guide slot 511 and the guide protrusion 521 and the mechanical relationship therebetween have been described above and thus, will not be described any more.

The open/close operation drive unit 530 serves to apply a moving force (depicted by "Fp" in FIG. 3) to the movable frame 520. As illustrated in FIG. 27, the open/close operation drive unit 530 includes: a side sliding bar 532 installed vertically on the fixed frame 510 on a side surface of the moving window 300 to be movable upward and downward; a rotation handle **531*h* installed so as to apply an operating force for moving the side sliding bar 532 upward and downward; a gear mechanism installed to convert the rotating movement of the rotation handle 531*h* and including a rack 531L and a pinion 531P; a flexible slider 533 installed at a corner of the fixed frame 510 to be connected with the side sliding bar 532 so as to transfer the reciprocal movement to the upper portion or lower portion of the moving window 300; an upper or lower sliding bar 534 installed to be movable in the horizontal direction in the fixed frame 510 at the upper or lower portion of the moving window 300 so as to be interlocked with the flexible slider 533; and a connecting rod member 535 that links the upper or lower sliding bar 534 to the movable frame 520. As an example, a control unit and a motor (not illustrated) may be used instead of the handle 531*h*** in order to implement the automatic open/close function.

The front support rail 540 and the rear support rail 550 are provided in the window frame 100 at the left and right sides of the central rail 110 to be spaced apart from each other by a predetermined spacing. In addition, the heights of the front support rail 540 and the rear support rail 550 are set to be lower than the height of the fixed frame 510 such that the fixed frame 510 does not interfere with the front support rail 540 and the rear support rail 550. In particular, the front support rail 540 and the rear support rail 550 serve to provide a reaction force in the direction opposite to the compression unit 560 when the compression unit 560 to be described later pushes the front support rail 540 (or the rear support rail 550). Consequently, the moving window 300 will be moved to the right (or left) which is orthogonal to the rail travel direction by the reaction force.

As illustrated in FIG. 31, the compression unit 560 is provided on the movable frame 520 in which, when the movable frame 520 is moved by the open/close operation drive unit 530, the compression unit 560 moves the front support rail 540 or the rear support rail 550 so as to move the moving window 300 in the vertical direction. Specifically, as illustrated in FIGS. 31 and 34, the compression unit 560 may include a support member 561 fixed to an end of the guide protrusion 521 of the movable frame 520 and slidably provided on the bottom surface of the fixed frame 510, and a circular compression roller 562 rotatably provided on the support member 561. In particular, since the circular compression roller 562 is rotatably provided on the support member 561, the circular compression roller 562 may move the moving window 300 while directly pushing the front support rail 540 or the rear support rail 550, and may also minimize contact friction with the front support rail 540 or the rear support rail 550 while the movable frame 520 and the support member 561 are moved over a predetermined distance along the inclined guide slot 511 by the guide protrusion 521.

In addition, as illustrated in FIGS. 31 and 35, the circular compression roller 562 is rotatably provided at the center of the bottom surface of the support member 561, and the diameter D of the circular compression roller 562 may be set to be smaller than the spacing between the front support rail 540 and the rear support rail 550, and to allow the moving window 300 to be moved by a predetermined distance in the vertical direction by the moving window horizontal-moving device 500. Accordingly, since the circular compression roller 562 is not contacted with the front support rail 540 and the rear support rail 550 at the same time, the circular compression roller 562 may be smoothly rotated and consequently, the contact resistance between the circular compression roller 562 and the front support rail 540 (or the rear support rail 550) may be minimized.

In addition, when an extension movable frame (not illustrated) is provided to be spaced apart from the movable frame 520 by a predetermined distance in order to extend the length of the movable frame 520, the above-described support member 561 may perform a role as a connecting member that interconnects the movable frame 520 and the extension movable frame (not illustrated).

In addition, the above-mentioned moving window horizontal-moving device 500 may further include a lubricant sheet 570 provided between the support member 561 and the fixed frame 510 such that the movable frame 520 and the support member 561 may be smoothly slid on the fixed frame 510.

Hereinafter, the above-described roller device 400 will be described in more detail with reference to FIG. 29 and FIGS. 32 to 34.

As illustrated in FIGS. 32 to 34, the roller device 400 may include: a bottom-opened housing 410; a plate-shaped weight support plate 420 mounted within the housing 410 to support the weight of the moving window 300; and an annular rolling unit 430 wound around the weight support plate 420 to be rotated around the weight support plate 420 as an axis when the moving window 300 is moved along the central rail 110 of the window frame 100. Here, the annular rolling unit 430 may include a plurality of rolling members 431, and a link unit 432 interconnecting the plurality of rolling members 431 such that the plurality of rolling members 431 are evenly arranged on the surface of the weight support plate 420 at a predetermined interval.

In addition, as illustrated in FIG. 34, the above-described roller device 400 may further include a guide unit 440 that guides the annular rolling unit 430 to the left and right of the weight support plate 420 without slip. As an example, the guide unit 440 may include a guide rail 441 formed on the weight support plate 420 therearound, and guide grooves 442 which are formed on the plurality of rolling members 431, respectively, to correspond to the guide rail 441.

In addition, as illustrated in FIGS. 28 and 29, the above-described rail guide 100*r* may further include an auxiliary guide rail 120, of which the longitudinal direction is the same as the longitudinal direction of the central rail 110. The auxiliary guide rail 120 is formed to protrude on a plane of the central rail 110. The auxiliary guide rail 120 may be inserted into the guide grooves 442 so as to prevent the roller device 400 from rocking from side to side.

In addition, as illustrated in FIGS. 29 and 32, the above-described roller device 400 may further include foreign matter curtains 450 which are provided at front and rear portions of the housing with reference to the moving direction of the housing, respectively, so as to prevent foreign matter on the central rail 110 and the auxiliary guide rail 120 from being introduced into the housing 410 and to cause the foreign matter to be swept to the outside of the housing 410. In addition, a recess 451 may be formed at the center of each of the foreign matter curtains 450 so that the auxiliary guide rail 120 can be inserted into the recess 451.

In addition, as illustrated in FIG. 32, the above-described roller device 400 may further include side rollers 460 which are rotatably provided on the opposite side surfaces, respectively, so as to reduce contact resistance when the housing 410 is contacted with the front support rail 540 and the rear support rail 550.

Hereinafter, the operation of the moving window open/close apparatus of the sliding window system according to the exemplary embodiment of the present invention will be described in detail with reference to FIGS. 36 to 41.

First, a process, in which the moving window is moved to the right side, will be described with reference to FIGS. 36 and 38.

Figure 36:
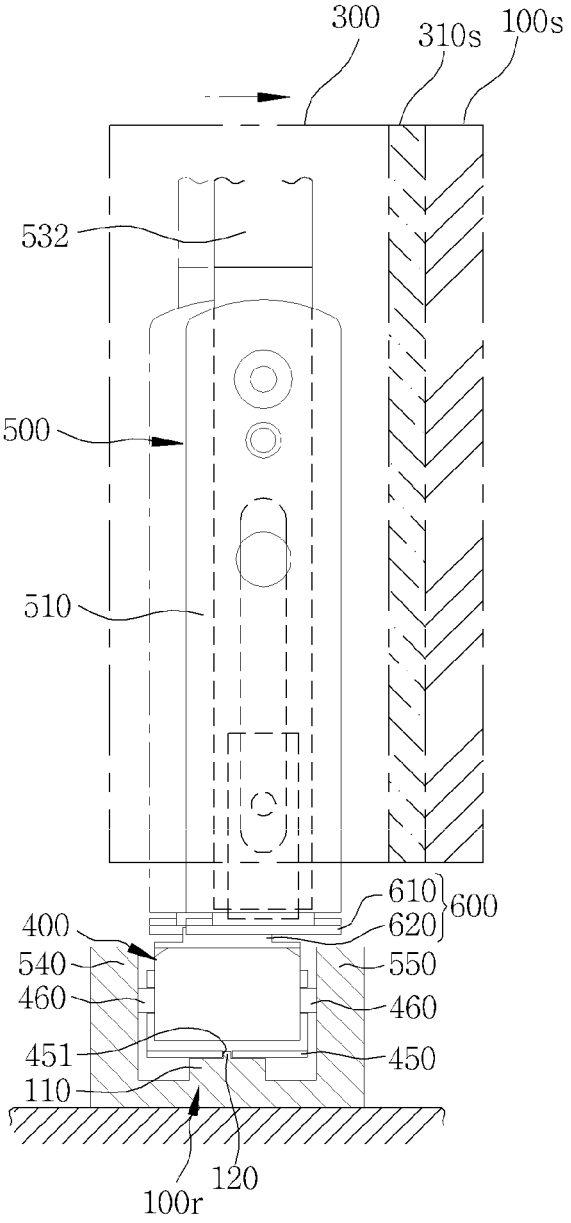
FIG. 36 is a side view illustrating a state in which the fixed frame, to which the moving window is fixed, is moved to the right side from the state illustrated in FIG. 28.
Figure 37:
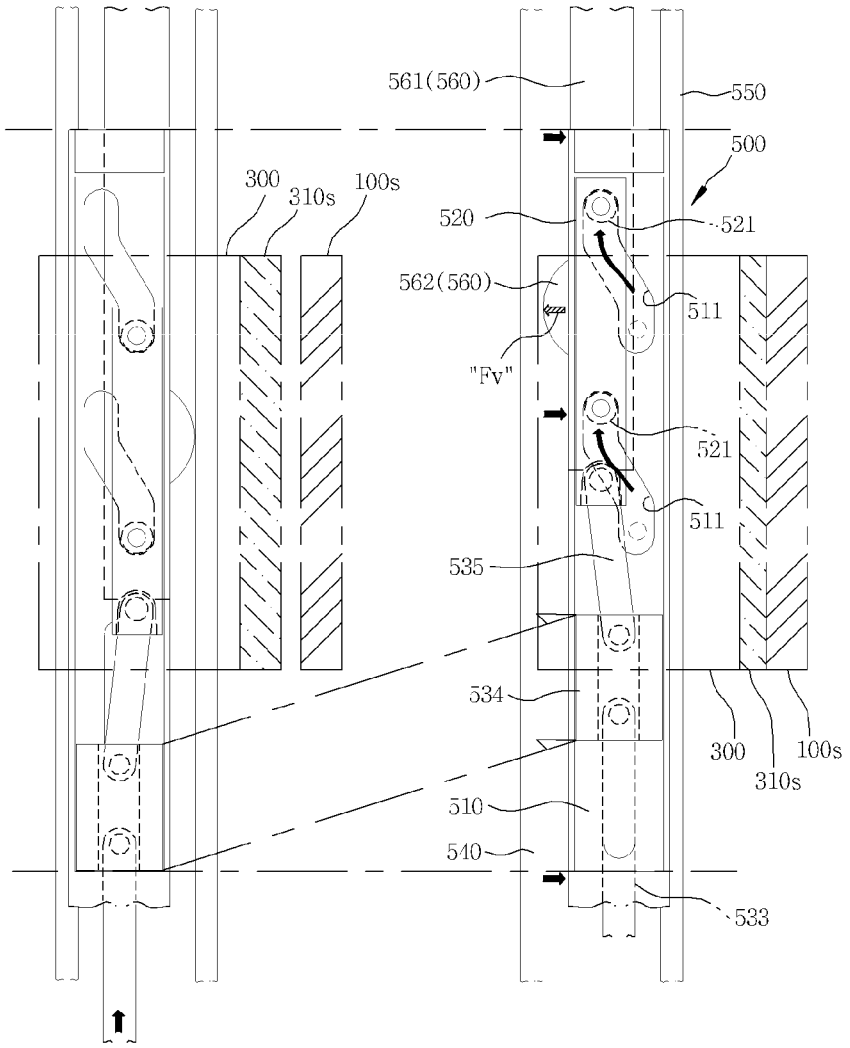
FIG. 37 is a plan view illustrating a state in which the fixed frame, to which the moving window is fixed, is moved to the right side from the state illustrated in FIG. 30 when the circular compression roller pushes the front support rail.
Figure 38:
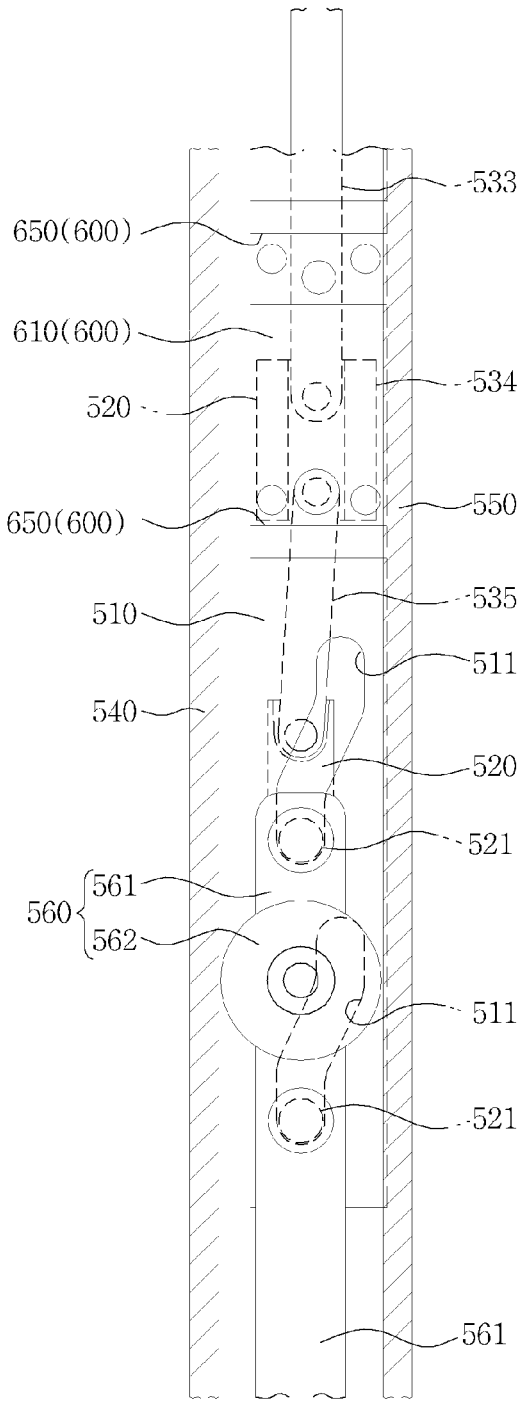
FIG. 38 is a bottom view illustrating a state where the fixed frame, to which the moving window is fixed, is moved to the right side from the state illustrated in FIG. 31 when the circular compression roller pushes the front support rail.

FIG. 36 is a side view illustrating a state in which the fixed frame 510, to which the moving window 300 is fixed, is moved to the right side from the state illustrated in FIG. 28, FIG. 37 is a plan view illustrating a state in which the fixed frame 510, to which the moving window is fixed, is moved to the right side from the state illustrated in FIG. 30 when the circular compression roller 562 pushes the front support rail 540 to support the vertical reaction force "Fv", and FIG. 38 is a bottom view illustrating a state where the fixed frame 510, to which the moving window 300 is fixed, is moved to the right side from the state illustrated in FIG. 31 when the circular compression roller 562 pushes the front support rail 540.

First, as illustrated in FIGS. 30, 31 and 36, when a user grips and rotates the handle 531*h* to operate the gear mechanism 531P, 531L such that the side sliding bar 532 positioned on a side surface of the moving window 300 is moved down, the movable frame 520 is moved substantially in the rail travel direction (on the drawings, in the upward direction) as illustrated in FIGS. 30 and 37 and thus the guide protrusion 521 of the movable frame 520 is moved along the inclined guide slot 511 of the fixed frame 510. During the movement, the compression unit 560 of the support member 561 provided on the movable frame 520 comes into contact with the front support rail 540 and moves in the rail travel direction over a predetermined distance, thereby gradually pushing the front support rail 540 (see FIGS. 31 and 32). At this time, while pushing the front support rail 540, the compression unit 560 receives a reaction force in the opposite direction from the front support rail 540 fixed to the window frame 100 in which the reaction force also arrives at the guide protrusion 521 fixed to the compression unit 560. During this, due to the mechanical relationship between the inclined guide slot 511 and the guide protrusion 521 inserted therein, the fixed frame 510 and the moving window 300 fixed thereto (see FIG. 28) are moved in the direction orthogonal to the rail travel direction which is the right side on the drawings, as illustrated in FIGS. 28 and 36. As a result, as the second thermal break sealing member 310*s*, which has a certain elasticity and is installed on the rear surface of the moving window 300, is pressed against the front surface of the first thermal break sealing member 100*s* of the moving window sealing frame 100*d* within the window frame 100 (see FIG. 36), an excellent performance with respect to, for example, a soundproof property, an airtight property, a watertight property, an heat insulation property, and a wind pressure resistance property, may be provided.

Hereinafter, a process, in which the moving window 300 illustrated in FIG. 29 is moved to the left side, will be described with reference to FIGS. 39 to 41.

Figure 39:
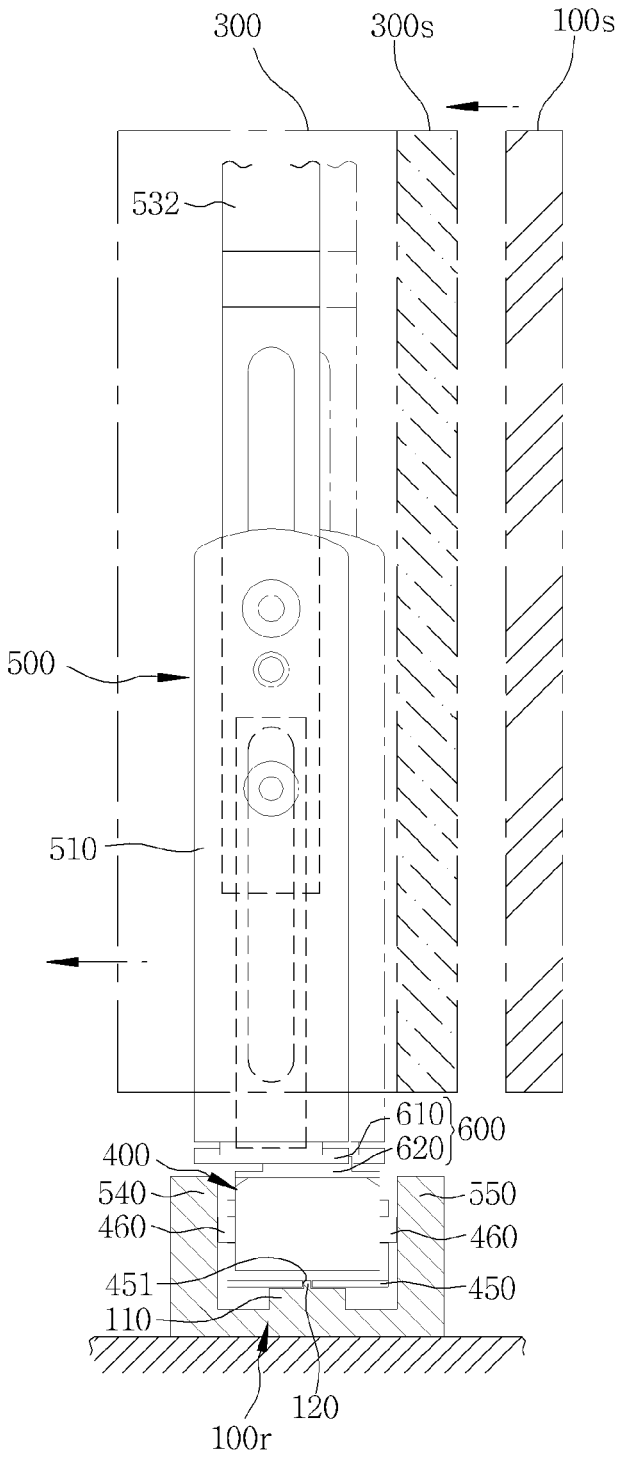
FIG. 39 is a side view illustrating a state where the fixed frame, to which the moving window is fixed, is moved to the left side from the state illustrated in FIG. 28.
Figure 40:
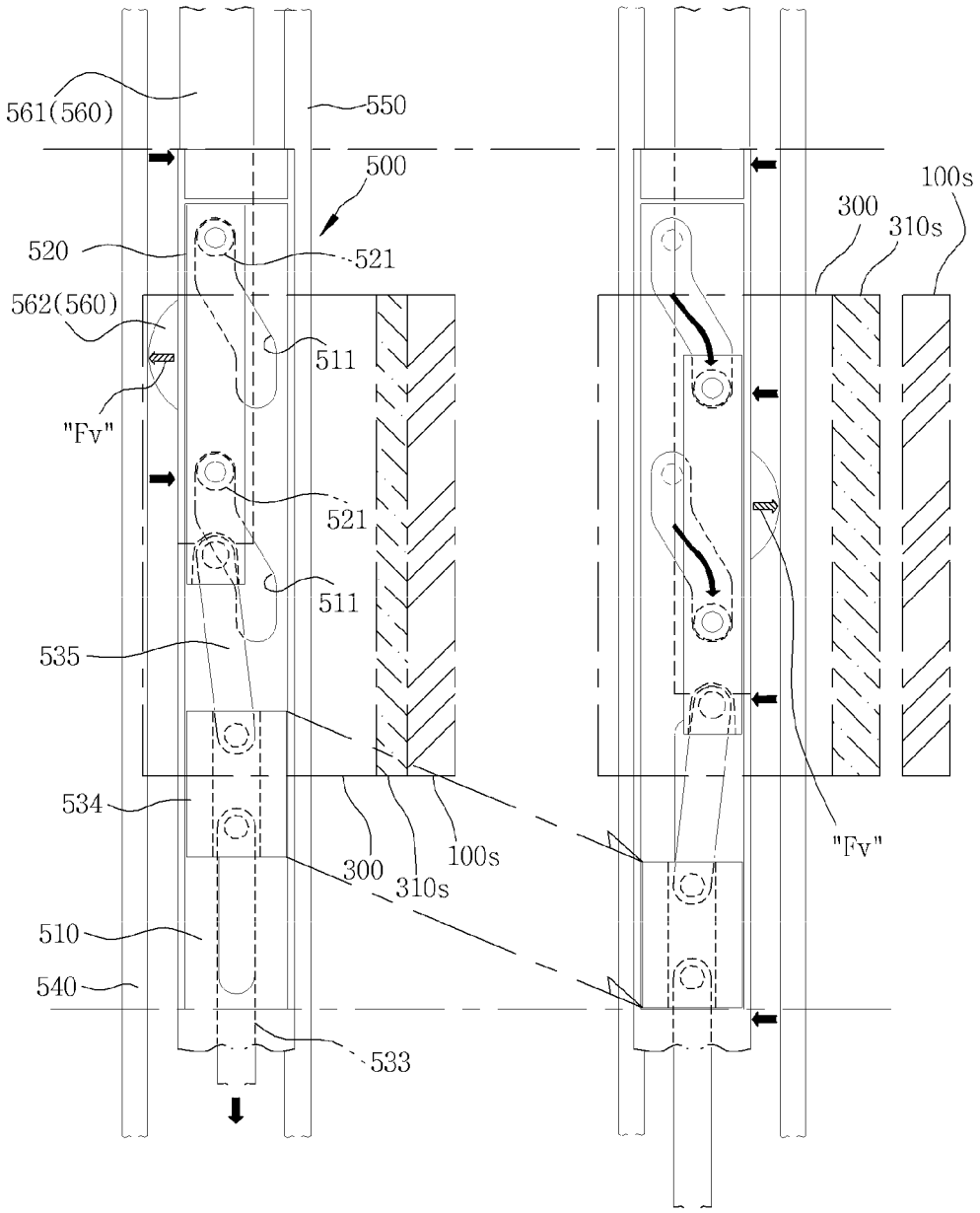
FIG. 40 is a plan view illustrating a state where the fixed frame, to which the moving window is fixed, is moved to the left side from the state illustrated in FIG. 30 when the circular compression roller pushes the rear support rail.
Figure 41:
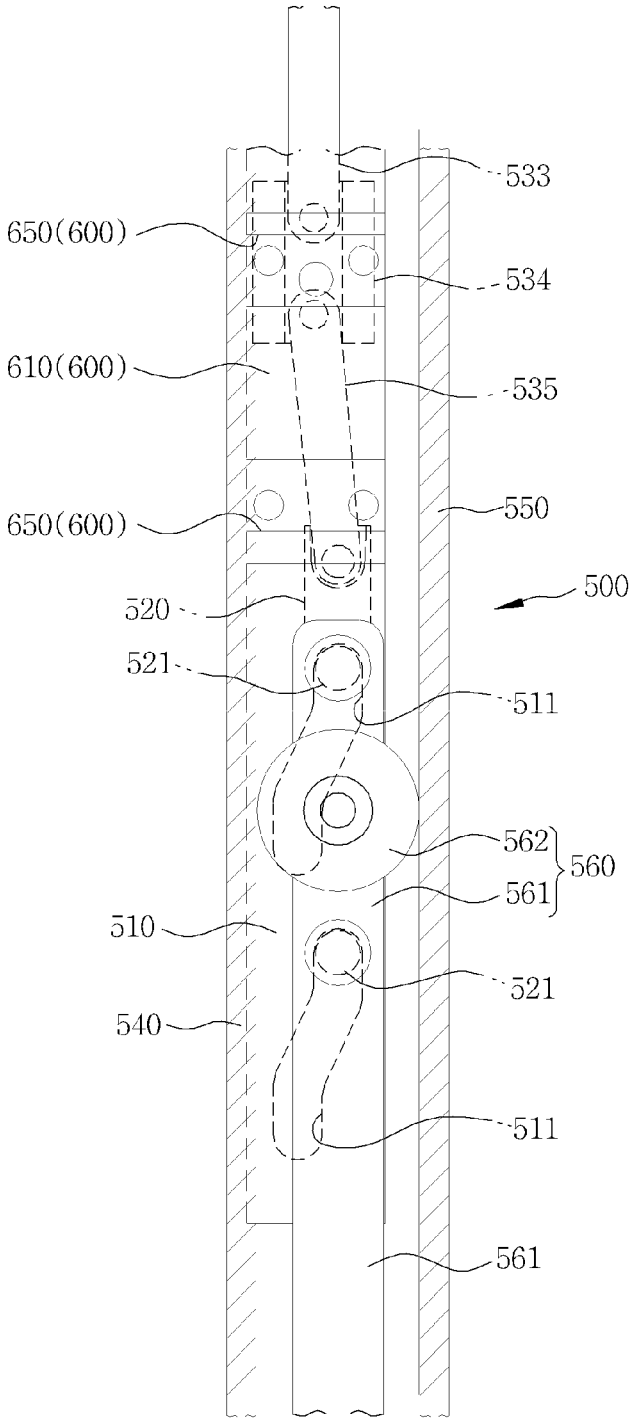
FIG. 41 is a bottom view illustrating a state where the fixed frame, to which the moving window is fixed, is moved to the left side from the state illustrated in FIG. 31 when the circular compression roller pushes the rear support rail.

FIG. 39 is a side view illustrating a state where the fixed frame 510, to which the moving window 300 is fixed, is moved to the left side from the state illustrated in FIG. 28, FIG. 40 is a plan view illustrating a state where the fixed frame 510, to which the moving window 300 is fixed, is moved to the left side from the state illustrated in FIG. 30 when the circular compression roller 562 pushes the rear support rail 550, and FIG. 41 is a bottom view illustrating a state where the fixed frame 510, to which the moving window 300 is fixed, is moved to the left side from the state illustrated in FIG. 31 when the circular compression roller 562 pushes the rear support rail 550.

First, as illustrated in FIGS. 28 and 39, when the user grips and rotates the handle 531*h* to operate the gear mechanism 531P, 531L in the opposite direction so as to move the side sliding bar 532 positioned on the side surface of the moving window 300 upward, the movable frame 520 is moved substantially in the rail travel direction (on the drawings, in the downward direction) as illustrated in FIGS. 30 and 40 and thus the guide protrusion 521 of the movable frame 520 is moved along the inclined guide slot 511 of the fixed frame 510. During the movement, the compression unit 560 of the support member 561 provided on the movable frame 520 comes into contact with the rear support rail 550 and moves over a predetermined distance in the rail travel direction, thereby gradually pushing the rear support rail 550 (see FIGS. 31 and 41). At this time, while pushing the rear support rail 550, the compression unit 560 receives a reaction force in the opposite direction from the rear support rail 550 fixed to the window frame 100 in which the reaction force also arrives at the guide protrusion 521 fixed to the compression unit 560. During this, due to the mechanical relationship between the inclined guide slot 511 and the guide protrusion 521 inserted therein, the fixed frame 510 and the moving window 300 fixed thereto are moved in the direction orthogonal to the rail travel direction which is the left side on the drawings, as illustrated in FIGS. 28 and 36. As a result, as the second thermal break sealing member 310*s*, which has a certain elasticity and is installed on the rear surface of the moving window 300, is completely separated from the first thermal break sealing member 100*s* of the moving window sealing frame 100*d* within the window frame 100, the frictional resistance caused due to the contact of the first thermal break sealing member 100*s* and the second thermal break sealing member 310*s* can be fully removed and thus the moving window 300 can be easily moved.

Meanwhile, although the moving window horizontal-moving device 500 has been illustrated in the accompanying drawings and described above with reference to a lower portion of the moving window 300 where the roller device 400 is installed, it shall be understood that the moving window horizontal-moving device 500 is also installed at the upper portion of the moving window 300 in a symmetric structure.

According to the exemplary embodiments of the present invention as described above, the moving window open/close apparatus of the sliding window system can exhibit the following effects.

According to the exemplary embodiments, since the vertical sliding unit 600 is provided between the roller device 400 and the fixed frame 510 such that no vertical reaction force is applied between the roller and the rail, the moving window 300 fixed to the fixed frame 510 can be smoothly moved in the direction orthogonal to the longitudinal direction of the rail (i.e., the rail travel direction) and thus the open/close apparatus can be operated using a force which is smaller than that required in the prior art. In addition, because the moving window 300 can be smoothly moved in the vertical direction by the vertical sliding unit 600, the open/close apparatus can be operated with a small force even if a moving window with a heavy weight is applied.

In addition, according to an exemplary embodiment, the roller device 400 is provided with the guide unit 440 and the window frame 100 is provided with the auxiliary guide rail 120. As a result, rocking of the roller device 400 from side to side can be minimized and the stable operation of the window system can be implemented. Further, because the foreign matter curtains 450 are provided on the roller device 400, the foreign matter existing on the auxiliary guide rail 120 and the central rail 110 can be swept outside without being introduced into the roller device, the stable operation of the window system can be continuously performed. Consequently, the reliability for the window system can be enhanced.

Although exemplary embodiments of the present invention have been described above, the scope of the present invention is not limited thereto, and various changes and modifications made using the basic concept of the present invention by a person ordinarily skilled in the art also belong to the scope of the present invention.

The invention claimed is:

1. A moving window installation structure, the moving window installation structure comprising:

a window frame (100) including a first inner frame (100*a*) and a first outer frame (100*b*) which are made of an aluminum alloy material, and a first thermal break (100*c*1) which interconnects the first inner frame (100*a*) and the first outer frame (100*b*) in a heat transfer blocking manner, the first thermal break (100*c*1) being made of a synthetic resin, the window frame (100) being installed in a rectangular shaped opening in a building wall and a rail guide (100*r*) being installed in a horizontal direction on a bottom surface of the window frame (100);

a fixed window (200) installed within the window frame (100);

a moving window (300) installed within the window frame (100), the moving window (300) including a second inner frame (300*a*) and a second outer frame (300*b*) which are configured to support a window panel (300*g*) and the moving window (300) being made of an aluminum alloy material, and an inner thermal break (300*c*) interconnecting the second inner frame (300*a*) and the second outer frame (300*b*), and the inner thermal break (300*c*) is made of a synthetic resin;

a sealing frame (100*d*) for the moving window including, on a front surface, a first thermal breaking and sealing member (100*s*), the sealing frame (100*d*) being made of an aluminum alloy material and provided in a rectangular shaped opening in a moving window closing region inside the first outer frame (100*b*) of the window frame (100) to interconnect the first inner frame (100*a*) and the first outer frame (100*b*);

a second thermal break (100*c*2) interconnecting the sealing frame (100*d*) and the first inner frame (100*a*) in a heat transfer blocking manner, and the second thermal break (100*c*2) is made of a synthetic resin;

a second thermal breaking and sealing member (310*s*) provided on a rear surface of the moving window (300) for contacting with the first thermal breaking and sealing member (100*s*) of the sealing frame (100*d*);

a roller device (400) installed on a center rail (110) of the rail guide (100*r*) and installed below the moving window (300) and separated from the moving window (300) so as to allow the moving window (300) to slide orthogonally relative to the rail guide (100*r*) of the window frame (100) for sealing in relation to the sealing frame (100*d*);

a moving window orthogonal-moving device (500) installed between an inner pocket of a lower frame (300*d*) of the moving window (300) and the rail guide (100*r*) to conduct an orthogonal sealing sliding movement for sealing across the rail guide (100*r*) such that the second thermal breaking and sealing member (310*s*) comes in contact with the first thermal breaking and sealing member (100*s*) of the sealing frame (100*d*) by separating the moving window (300) from the roller device (400); and an orthogonal sliding unit (600) provided between a top surface of the roller device (400) and a bottom surface of the lower frame (300*d*) of the moving window (300) so as to guide rolling movement of the moving window while allowing only a moving displacement of the lower frame (300*d*) of the moving window (300) orthogonal to a rail travel direction of the rail guide (100*r*) in relation to the top surface of the roller device (400), so that an orthogonal component force is not applied to the roller device (400) engaged to the center rail while the moving window (300) conducts the orthogonal sealing sliding movement across the rail guide (100*r*) by the operation of the moving window orthogonal-moving device (500), and the moving window (300) and the roller device (400) can travel integrally while the moving window (300) is moved along a longitudinal direction of the rail guide (100*r*), wherein said first thermal break (100*c*1) and said second thermal break (100*c*2) are arranged such that installation directions of the thermal breaks (100*c*1, 100*c*2) are orthogonal to each other, and thus the first inner frame (100*a*), the first outer frame (100*b*), and the sealing frame (100*d*) are connected in a rectangular shaped opening through the first and second thermal breaks (100*c*1, 100*c*2: 100*c*) so as to form a thermal insulation air layer (300*i*) therein, and wherein the moving window orthogonal-moving device (500) installed between the inner pocket (300*d*1) of the lower frame (300*d*) of the moving window (300) and the rail guide (100*r*) includes:

a fixed frame (510) fixedly installed on the moving window (300) and including an inclined guide slot (511) formed to be inclined at a predetermined angle in relation to the longitudinal direction of the rail guide (100*r*);

a movable frame (520) slidably provided adjacent to the fixed frame (510), and including a guide protrusion (521) formed to protrude from a frame surface so that the guide protrusion is inserted into the inclined guide slot to be guided in a sliding manner, the movable frame (520) being provided in the inner pocket (300*d*1) of the lower frame (300*d*) of the moving window (300) to be slidable in a direction parallel to the rail travel direction of the rail guide (100*r*);

an opening and closing operation drive unit (530) fixedly installed on a side surface of the moving window (300) and connected to the movable frame (520) to apply a moving force in the direction parallel to the rail travel direction;

a front support rail (540) and a rear support rail (550) provided on the front surface and the rear surface of the center rail (110) of the rail guide (100*r*) in the window frame (100), respectively, to be spaced apart from each other by a predetermined spacing; and a compression unit (560) provided on the movable frame (520) such that when the movable frame (520) is moved by the opening and closing operation drive unit (530), the compression unit (560) pushes the front support rail (540) or the rear support rail (550) fixed to the window frame (100) and moves with the movable frame (520) between the front support rail (540) and the rear support rail (550).

2. The moving window installation structure of claim 1, wherein a side flexure rigidity reinforcement member is inserted and installed in a reinforcement material pocket (300*d*3), the side flexure rigidity reinforcement member additionally formed adjacent to a side pocket (300*d*2) in which the movable frame (520) constituting the moving window orthogonal-moving device (500) is provided to extend from the inner pocket (300*d*1) of the lower frame (300*d*) of the moving window (300) to the opening and closing drive unit (530) on the side surface of the moving window (300), so as to reinforce the flexural rigidity in the vertical longitudinal direction of the moving window (300).

3. The moving window installation structure of claim 1, wherein the orthogonal sliding unit (600) is provided between the roller device (400) and the moving window orthogonal-moving device (500) such that no orthogonal component force is applied to the roller device (400) while the moving window (300) is slid for sealing in the orthogonal direction by the moving window orthogonal-moving device (500), and wherein the orthogonal sliding unit (600) includes:

a flat plate member (610) provided on a bottom surface of the fixed frame (510); and a bearing unit (620) provided on a plane of the roller device (400), the bearing unit to be in contact with the plate member (610) and configured to slip only in a direction orthogonal to the longitudinal direction of a rail guide (100*r*).

4. The moving window installation structure of claim 3, wherein the bearing unit (620) includes a bearing mount provided on the plane of the roller device (400), and one or more pin type roller bearings which are arranged in the bearing mount (621) to be oriented in the same longitudinal direction as the longitudinal direction of the rail guide (100*r*).

5. The moving window installation structure of claim 4, wherein, in order to provide a structure which slips only in the direction orthogonal to the longitudinal direction of the rail guide (100*r*), the orthogonal sliding unit (600) includes a first engagement step provided on a bottom surface of the fixed frame, and a second engagement step formed on the plane of the roller device is engaged with the first engagement step on the fixed frame.

6. The moving window installation structure of claim 3, wherein the compression includes a support member which is fixed to an end of the guide protrusion of the movable frame and slidably provided on the bottom surface of the fixed frame, and a circular compression roller which is rotatably provided on the support member such that the circular compression roller moves the moving window while directly pushing the front support rail or the rear support rail, and also minimizes contact friction with the front support rail or the rear support rail while the movable frame and the support member (561) are moved over a predetermined distance.

7. The moving window installation structure of claim 6, wherein the circular compression roller is rotatably provided at a center of a bottom surface of the support member, and the diameter of the circular compression roller is set to be smaller than the spacing between the front support rail and the rear support rail, and the circular compression roller allows the moving window to be moved by a predetermined distance in the orthogonal direction by the moving window orthogonal-moving device (500).

8. The moving window installation structure of claim 3, wherein the moving window orthogonal-moving device (500) further includes a lubricant sheet provided between a support member and the fixed frame such that the movable frame and the support member is smoothly slid on the fixed frame.

9. The moving window installation structure of claim 3, wherein the roller device (400) includes: a bottom-opened housing; a weight support plate mounted within the housing to support the weight of the moving window; and an annular rolling unit wound around the weight support plate to be rotated around the weight support plate as an axis of rotation when the moving window is moved along a central rail of the window frame, and wherein the annular rolling unit includes a plurality of rolling members, and a link unit interconnecting the plurality of rolling members such that the plurality of rolling members are evenly arranged on a surface of the weight support plate at a predetermined interval.

10. The moving window installation structure of claim 9, wherein the roller device (400) further includes a guide unit that guides the annular rolling unit without slipping to the left and right of the weight support plate, and wherein the guide unit includes a guide rail formed on the weight support plate therearound, and guide grooves which are formed on the plurality of rolling members, respectively, to correspond to the guide rail.

11. The moving window installation structure of claim 10, wherein the roller device (400) further includes side rollers which are rotatably provided on the opposite side surfaces, respectively, so as to reduce contact resistance when the housing is contacted with the front support rail and the rear support rail.

12. The moving window installation structure of claim 10, wherein the rail guide further includes a central rail provided between the front support rail and the rear support rail to guide the plurality of rolling members; and an auxiliary guide rail having a longitudinal direction which is the same as that of the central rail and formed to protrude on a plane of the central rail, and the auxiliary guide rail is inserted into the guide grooves so as to prevent the roller device (400) from rocking from side to side.

13. The moving window installation structure of claim 12, wherein the roller device (400) further includes side rollers which are rotatably provided on the opposite side surfaces, respectively, so as to reduce contact resistance when the housing is contacted with the front support rail and the rear support rail.

14. The moving window installation structure of claim 12, wherein the roller device further includes foreign matter curtains which are provided at front and rear portions of the housing with reference to the moving direction of the housing, respectively, so as to prevent foreign matter on the central rail and the auxiliary guide rail from being introduced into the housing and to cause the foreign matter to be swept to the outside of the housing.

15. The moving window installation structure of claim 14, wherein the roller device (400) further includes side rollers which are rotatably provided on the opposite side surfaces, respectively, so as to reduce contact resistance when the housing is contacted with the front support rail and the rear support rail.

16. The moving window installation structure of claim 9, wherein the orthogonal sliding unit (600) is provided between the housing of the roller device (400) and the fixed frame of the moving window orthogonal-moving device (500).

17. The moving window installation structure of claim 16, wherein the roller device (400) further includes side rollers which are rotatably provided on the opposite side surfaces, respectively, so as to reduce contact resistance when the housing is contacted with the front support rail and the rear support rail.

18. The moving window installation structure of claim 9, wherein the roller device (400) further includes side rollers which are rotatably provided on the opposite side surfaces, respectively, so as to reduce contact resistance when the housing is contacted with the front support rail and the rear support rail.

19. The moving window installation structure of claim 9, wherein a side flexure rigidity reinforcement member is inserted and installed in a reinforcement material pocket (**300*d*3), the side flexure rigidity reinforcement member additionally formed adjacent to a side pocket (300*d*2) in which the movable frame (520) is provided to extend from the inner pocket (300*d*1) of the lower frame (300*d*) of the moving window (300) to the opening and closing drive unit (530) on the side surface of the moving window (300), so as to reinforce the flexural rigidity in the vertical longitudinal direction of the moving window (300**).

20. The moving window installation structure of claim 3, wherein a side flexure rigidity reinforcement member is inserted and installed in a reinforcement material pocket (**300*d*3), the side flexure rigidity reinforcement member additionally formed adjacent to a side pocket (300*d*2) in which the movable frame (520) is provided to extend from the inner pocket (300*d*1) of the lower frame (300*d*) of the moving window (300) to the opening and closing drive unit (530) on the side surface of the moving window (300), so as to reinforce the flexural rigidity in the vertical longitudinal direction of the moving window (300**).

* * * * *